US008044560B2

(12) United States Patent
Steigleman, Jr. et al.

(10) Patent No.: US 8,044,560 B2
(45) Date of Patent: Oct. 25, 2011

(54) SPARKPLUG WITH PRECISION GAP

(76) Inventors: Robert Lee Steigleman, Jr., Mira Loma, CA (US); Jimmy Robert Allen, II, Corona, CA (US)

( * ) Notice: Subject to any disclaimer, the term of this patent is extended or adjusted under 35 U.S.C. 154(b) by 371 days.

(21) Appl. No.: 12/231,130

(22) Filed: Aug. 29, 2008

(65) Prior Publication Data

US 2009/0096344 A1 Apr. 16, 2009

Related U.S. Application Data

(60) Provisional application No. 60/998,265, filed on Oct. 10, 2007.

(51) Int. Cl.
*H01T 13/20* (2006.01)

(52) U.S. Cl. ..... 313/139; 313/118; 313/122; 313/123; 313/140; 313/141

(58) Field of Classification Search ..... 313/122, 313/125, 118, 123, 139, 140, 141
See application file for complete search history.

(56) References Cited

U.S. PATENT DOCUMENTS 1,377,854 A * 5/1921 Roberts ..... 313/122
1,610,032 A 12/1926 Beason
3,312,848 A 4/1967 Baum
3,958,144 A 5/1976 Franks
4,695,758 A 9/1987 Nishida et al.
5,264,754 A 11/1993 Hanitijo et al.
5,280,214 A 1/1994 Johnson
5,430,346 A 7/1995 Johnson
5,469,013 A 11/1995 Kang
5,623,179 A 4/1997 Buhl
5,731,655 A 3/1998 Corrodo
5,767,613 A 6/1998 Kunt
5,936,332 A 8/1999 Krupa et al.
6,060,822 A 5/2000 Krupa et al.
6,091,185 A 7/2000 Matsubara et al.
6,121,720 A 9/2000 Rossi
6,357,274 B1 3/2002 Tanaka et al.
6,414,419 B1 7/2002 Kim
6,495,948 B1 12/2002 Garrett, III
6,566,793 B2 5/2003 Hond et al.
6,608,430 B1 8/2003 Schaus
6,628,049 B2 9/2003 Rosenthal et al.
6,670,740 B2 12/2003 Landon, Jr.
6,676,468 B2 1/2004 Ishigure et al.
6,794,802 B2 9/2004 Pollner
6,882,092 B1 4/2005 Nguyen

* cited by examiner

*Primary Examiner* — Nimeshkumar Patel
*Assistant Examiner* — Thomas A Hollweg

(57) ABSTRACT

The invention is a spark plug having multiple precise spark gaps (G} with a donut shaped electrode (20) attached to the firing end of the central electrode (32), as well as a cylindrical ground sleeve (40) that is pressed on to the primary shell (36) of the spark plug. The electrode donut (20) is generally flat and laded out in a radial direction towards the ground prongs (42) that protrude up towards the firing end from the ground sleeve (40). In conjunction with their structure, allow for the generation of a spark from every single ground prong (42) on the ground sleeve (40). This is spark potential area (G). Such multiple spark potential area along with the electrode donut (20) and ground sleeve (40) relation provides a more rapid and complete combustion of the air-fuel mixture within the internal combustion engine, which, in turn, results in more torque and more horse power.

17 Claims, 33 Drawing Sheets

18mm

.040" Gap

14mm
.040" Gap

12mm
.040" Gap

10mm
.040" Gap

18mm

14mm

12mm

10mm

SPARKPLUG WITH PRECISION GAP

CROSS-REFERENCE TO RELATED APPLICATIONS

This application claims the benefits of provisional patent application Ser. No. 60/998,265, Filed 2007 Oct. 10 by the present inventors, which is incorporated by reference here in.

FEDERALLY SPONSORED RESEARCH

Not applicable

SEQUENCE LISTINGS OR PROGRAMS

Not applicable

BACKGROUND

1. Field

This application relates to the sparkplug of an internal combustion engine, and more particularly, to the efficiency of the spark ability, of that sparkplug.

This application also relates to the manufacture and assembly, of that sparkplug.

2. Prior Art

In a 4 cycle internal combustion engine, the cycles are, starting at top dead center; this means that the piston is all the way at the top of the cylinder at the start of the cycle. The piston moves downward and the intake valve opens letting the air fuel mixture into the firing chamber, this is the intake cycle. When the piston reaches bottom dead center, the intake valve closes, and the piston moves up compressing the air fuel mixture, this is the compression cycle, and this creates a very fast moving wind storm type environment. When the piston reaches top dead center, the sparkplug will fire causing the compressed air fuel mixture to explode and force the piston downward, this is the power cycle. This is where the fuel is actually turned to kinetic energy that causes the internal combustion engine to operate. When the piston reaches bottom dead center, the exhaust valve will open and the piston will move upward and force the burnt air fuel mixture out of the firing chamber, which is 1 revolution of the internal combustion engine. 1 revolution happens, from 800 to over 10,000 times a minute this is called revolutions per minute or RPM'S.

The sparkplug will receive an electric charge of energy from the coil of the distributor system; this is called electro motive force this will cause the positive electrode to be energized with tens of thousands of volts. At that moment it tries to ionize a pathway to ground so as to let the electrons, from the ground, flow to the positive electrode, that flow of electrons is the spark.

Now do to the wind storm effect in the combustion chamber environment, the ionization of the pathway is impeded greatly do to the fact that the fast moving air fuel mixture blows the ionized path out and away from the ground. This happens several times before the pathway is finally established and the electrons can flow through the ionization path like electricity flows through a wire. This happens in less than 0.001 of a second.

The standard sparkplugs generally have a relatively small positive electrode and very little ground area, or multiple points of spark potential area for the ionization of the pathway to choose from. The ground prong is generally welded to the shell and protrudes up and over the positive electrode.

There have been many ideas to address these problems, ranging from good, but not complete, to poorly designed and manufactured. One idea is the U.S. Pat. No. 6,628,049, and the U.S. Pat. No. 6,608,430 these are basically the same plug and are a variation of the U.S. Pat. No. 1,610,032 of 1926, there is the multiple, but small points of spark potential area, and extended reach with the ring but the spark is still happening under the cap between the points and ground ring, vertical to the center line of the sparkplug, and if all the points, or spark potential areas are not the exact physical distance apart, this will impede the establishment of the ionization path as well. There are many that address the rapidly moving air fuel mixture, by using port holes in the extension ring.

Other ideas address the spark potential area like the U.S. Pat. No. 5,731,655 but have no way of guiding the flow of the air fuel mixture in the direction that the spark is, and the spark is under the disk vertical to the center line of the sparkplug, as well.

The U.S. Pat. No. 3,958,144 of 1976 shows ground configurations, that have some variations of porting and have the spark at the top of the plug but some of these look arbitrary and would do little to direct the flow in the direction of the spark, and again if the distances of the spark potential area isn't exact it will impede the spark.

It is therefore an object of the preferred embodiments to increase the spark ability of the sparkplug by giving it more spark potential area, and/or, points of spark, that are the exact physical distance.

It is another object of the preferred embodiments to direct the rapidly moving air fuel mixture to flow in the direction away from the positive electrode so as to have greater possibility of ionization. The rapidly moving air fuel mixture will help push the ionization in the direction of the ground, instead of impeding it.

It is an object of the application to disclose the method of manufacture and assembly to make the spark potential area, less than 0.0005 of an inch, respectively to one another, and to precisely set the gaps. This is to ensure that the spark gaps are equal in physical distance, and set to the size that is required for a specific application.

SUMMARY

In accordance with the preferred embodiments, there is provided multiple sparkplugs, to be used in various applications of the internal combustion engine, all with multiple points, and/or spark potential area, all with larger positive electrodes, all with unique structural, and construction element features, and will produce a spark horizontal to the center line of the sparkplug. These features will cause the spark to be at the very most top of the sparkplug, and in conjunction with the characteristics of the ground sleeves and the way they let the rapidly moving air fuel mixture flow in and around the spark potential area causes it to be faster. The thermo bonding of the positive electrode to the core electrode will create a positive charge, to add to the positive electrodes high voltage in the preferred embodiments of these inventions. These provisions in turn will cause the combustion to be faster and easier, this in turn will cause more torque and more house power for the internal combustion engine.

Also in accordance with the present invention there are a multiple number of assembly and manufacturing procedures to be used to achieve the preferred embodiments that are used in various applications of the internal combustion engine.

The multiple sparkplugs are different only in the fact that they are designed to perform with in the realms of a specific application but can still be used in an enormous number of applications.

DRAWINGS

Figures

Figure 1:
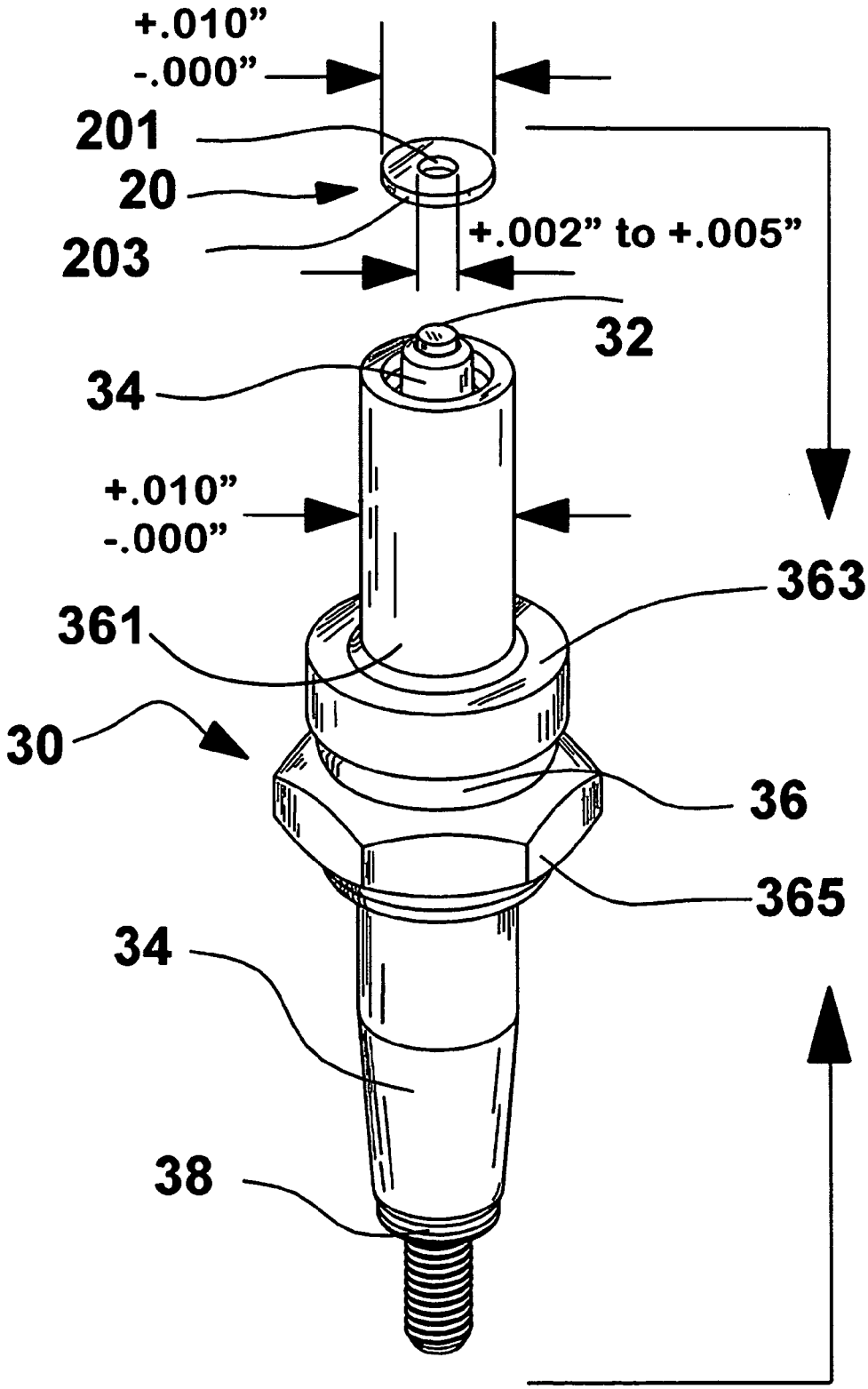
FIG. 1 is a perspective exploded view of the primary shell and insulator assembly and the electrode donut.

| DRAWINGS - Reference Numerals | |
|---|---|
| 10 | Preferred embodiment 1 |
| 12 | Preferred embodiment 2 |
| 14 | Preferred embodiment 3 |
| 20 | Electrode donut |
| 201 | Hole in the center of the electrode donut |
| 203 | Firing surface of the electrode donut |
| 30 | Primary shell and Insulator assembly |
| 32 | The core electrode |
| 34 | Insulator |
| 36 | Primary shell |
| 361 | Barrel portion of primary shell |
| 363 | Primary shoulder surface |
| 365 | Mounting nut |
| 367 | Surface area |
| 38 | Terminal |
| 40 | Ground sleeve |
| 401 | Surface area inside ground sleeve |
| 403 | Mating surface |
| 405 | Surface at head threshold |
| 42 | Ground prongs |
| 44 | The mounting threads |
| 46 | The base |
| 48 | The depth of the protrusion of the prongs |
| 50 | Ground sleeve of second embodiment |
| 56 | Base of ground sleeve second embodiment |
| 60 | Ground sleeve of third embodiment |
| 66 | Base of ground sleeve of third embodiment |
| 601 | Mounting nut of third embodiment |
| 603 | Flange |
| 70 | Type 1 cut out |
| 72 | Type 2 cut out |
| 74 | Type 3 cut out |
| 80 | Type 1 port hole |
| 82 | Type 2 port hole |
| 84 | Type 3 port hole |
| 90 | Head |
| 92 | Piston |
| 94 | Piston rod |
| 100 | Example 1 of the firing end configurations |
| 101 | Example 2 of the firing end configurations |
| 102 | Example 3 of the firing end configurations |
| 103 | Example 4 of the firing end configurations |
| 104 | Example 5 of the firing end configurations |
| 105 | Example 6 of the firing end configurations |
| 106 | Example 7 of the firing end configurations |
| 107 | Example 8 of the firing end configurations |
| 108 | Example 9 of the firing end configurations |
| 109 | Example 10 of the firing end configurations |
| 110 | Example 11 of the firing end configurations |
| W1 | Weld 1 |
| W2 | Weld 2 |
| W3 | Weld 3 |
| G | Spark potential area |

DETAILED DESCRIPTION

First Embodiment

Figure 2:
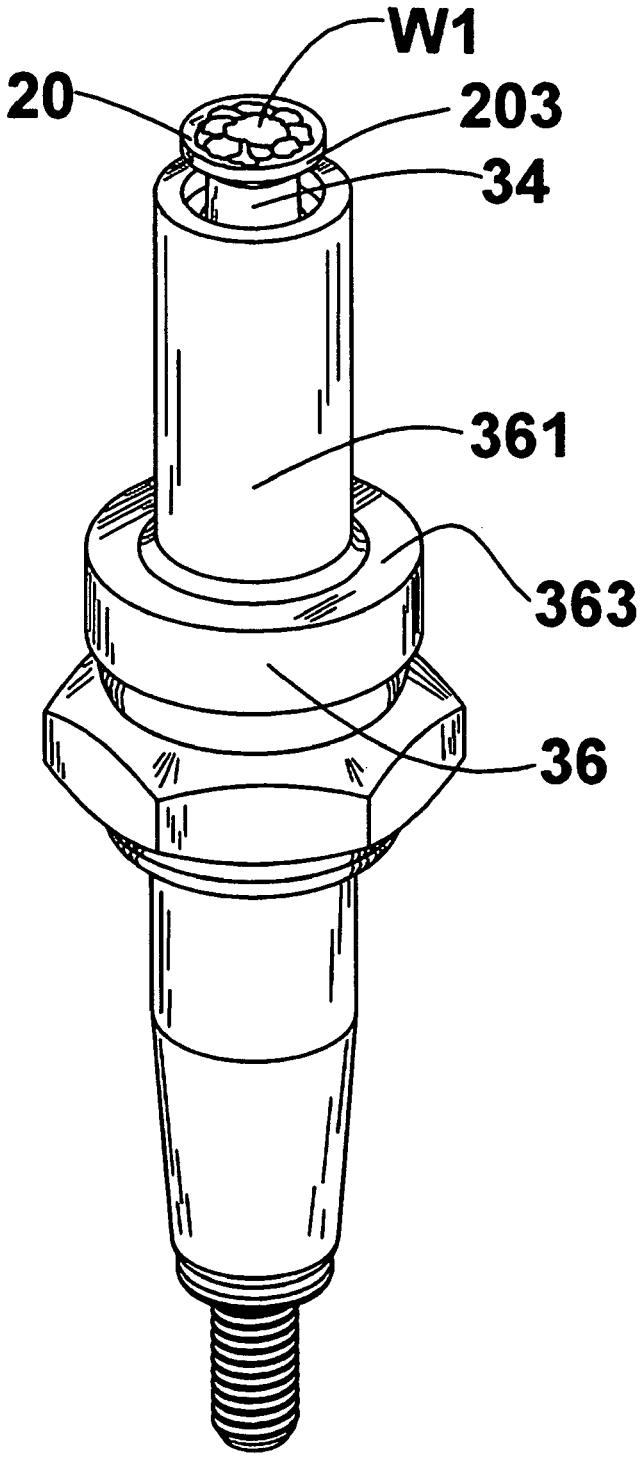
FIG. 2 is a perspective view of the primary shell and insulator assembly with electrode donut and weld.

FIG. 1 shows the primary shell and insulator assembly 30, the primary shell 36, which is made of a metallic material and houses the insulator 34, which is made of a ceramic type material, and is used for the electrical isolation of the core electrode 32 and terminal 38, from the primary shell 36. The core electrode 32, terminal 38 and the primary shell 36, are assembled in the same fashion as a standard sparkplug. The terminal 38 is the high voltage connection to, the ignition coil. The mounting nut 365 is for tightening the sparkplug into the head of the internal combustion engine. The barrel portion surface 361 is a locating surface. At this stage, the diameter of the barrel portion surface 361 is at least 0.010" larger than it will be at the time of assembly. Primary shoulder surface 363 is a locating surface and will be further machined as well. The electrode donut 20 is flat and disk shaped and is from 0.030" to 0.065" thick. The locating hole 201 is in the center of the electrode donut, and the diameter of the locating hole 201 is 0.002" to 0.005" larger than the diameter of the core electrode 32. The surface 203 is the firing surface. This is the surface that the spark jumps to from the ground. The diameter of firing surface 203 will constitute the size of the spark potential area, but at this stage it is at least 0.010" larger than it will be at the time of assembly. The electrode donut 20 fits on to the core electrode 32 in the direction shown by the arrows and is permanently bonded to the core electrode 32 as weld W1, shown in FIG. 2.

Figure 3:
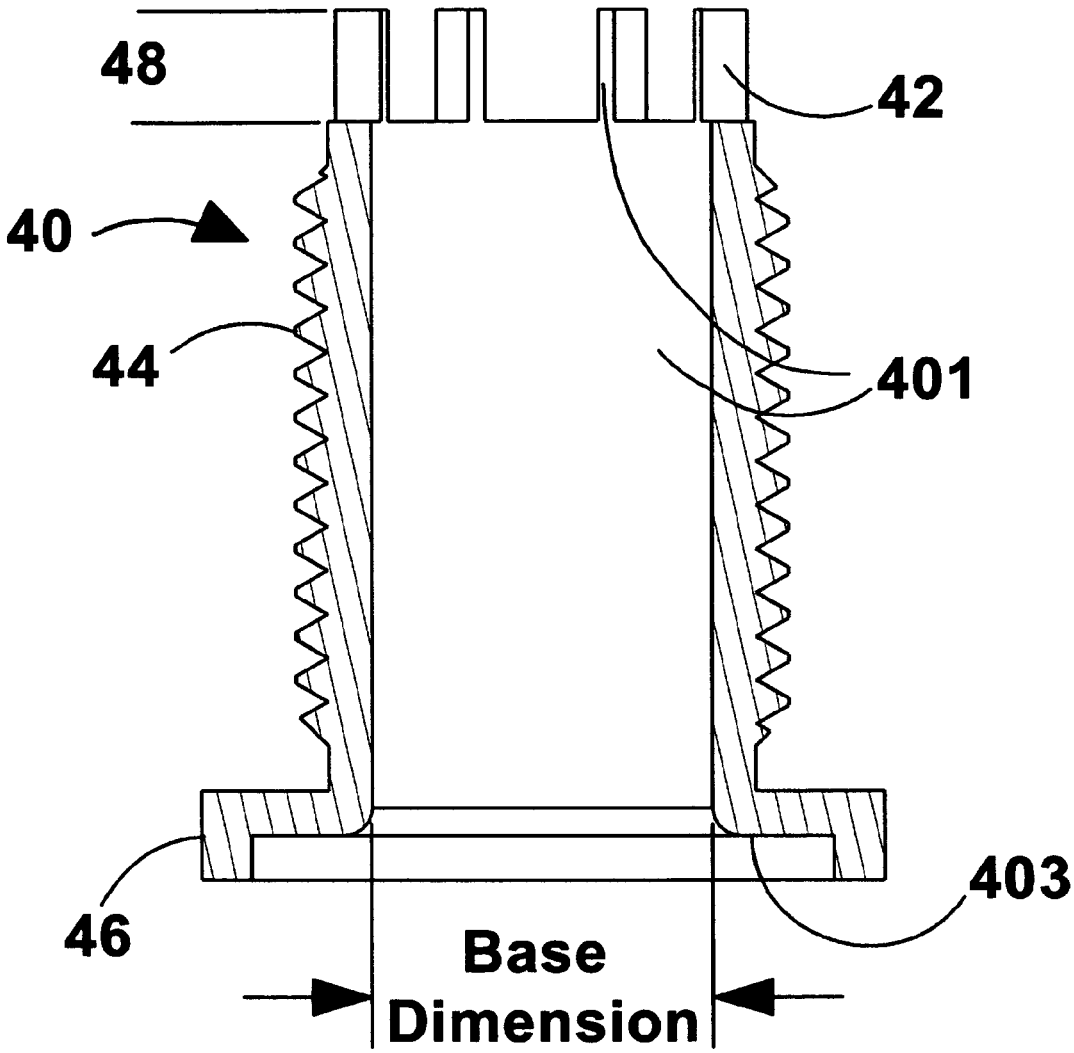
FIG. 3 is a front partial cross cut view of the ground sleeve.

FIG. 3 shows the ground sleeve 40, the mounting threads 44, the base 46, cylindrical surface 401, the mating surface 403, and the ground prongs 42. The mounting threads 44 are used to screw the sparkplug into the head of the internal combustion engine. The ground prongs 42 protrude up from the threaded portion and in to the combustion chamber of the internal combustion engine. Cylindrical surface 401 is the inside diameter of the ground sleeve 40 and the inside surface of the ground prongs 42.

Figure 4:
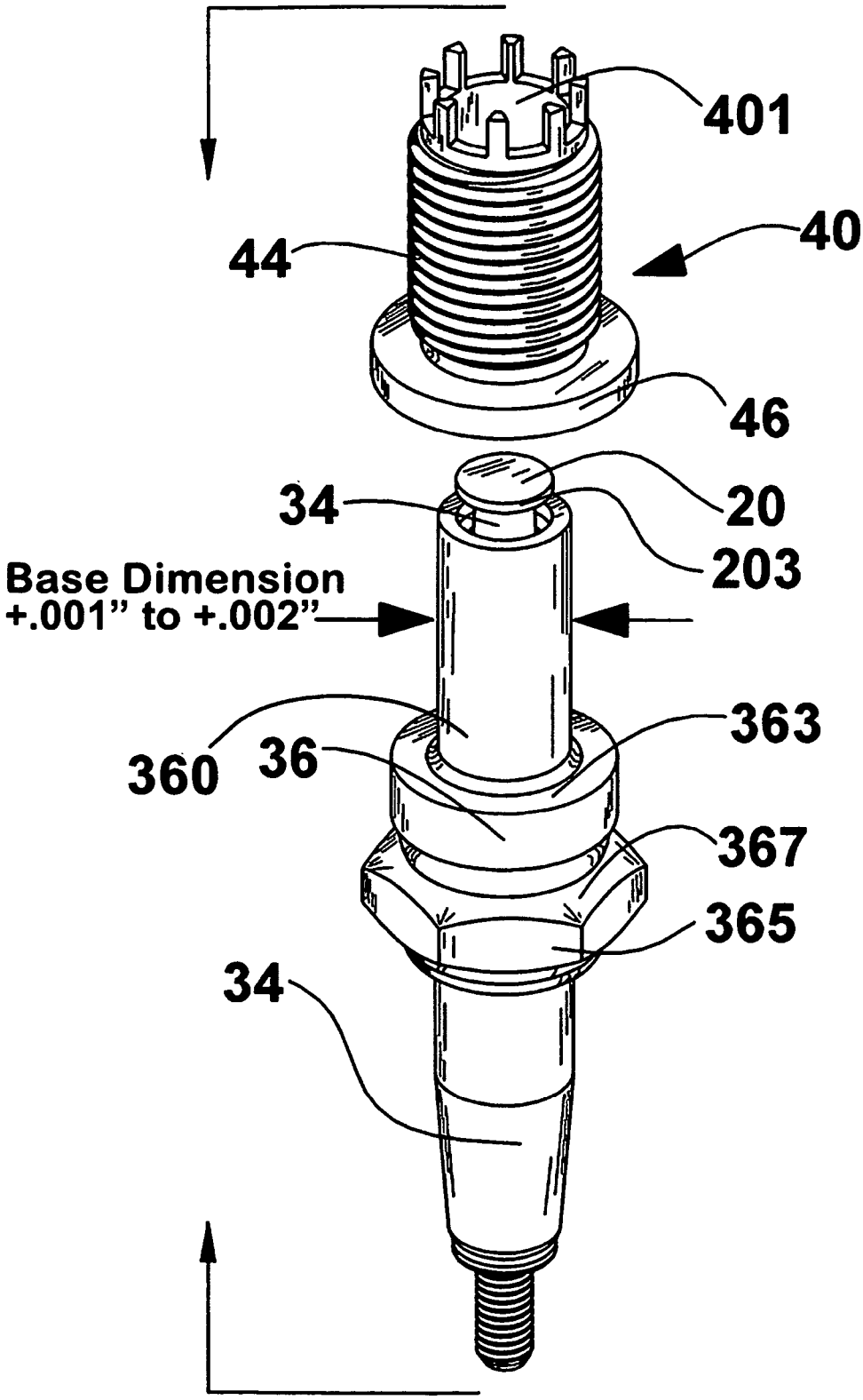
FIG. 4 is a perspective exploded view of the primary shell and insulator assembly and the ground sleeve.

After the electrode donut 20 is bonded to the core electrode 32 it will be machined so as to smooth polish the top surface 205 shown in FIG. 4. During this machining step firing surface 203 of the electrode donut 20 and barrel portion surface 361 of the primary shell 36 will be machined in the same step so as to make there diameters exactly concentric in respect to one another. Barrel portion surface 361 is machined so the diameter is from 0.001" to 0.002" larger than the diameter of cylindrical surface 401 of the ground sleeve 40. The diameter of firing surface 203 of the electrode donut 20 will determine the spark gap of the finished sparkplug. For example if you want a 0.040" spark gap, the formula is; the diameter of cylindrical surface 401−(0.040"×2)=the diameter of the electrode donut 20, firing surface 203. Primary shoulder surface 363 will also be machined in this process so as to make it precisely perpendicular to the center line of those diameters and parallel with top surface 205 of the electrode donut 20.

Figure 5:
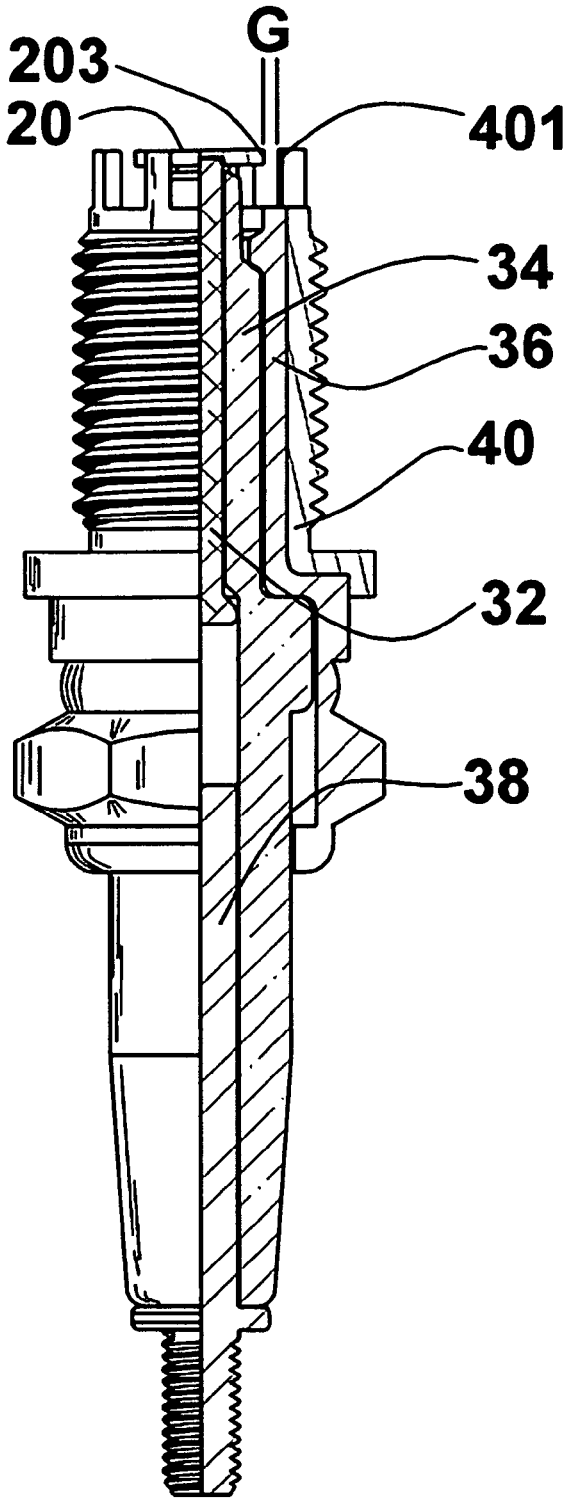
FIG. 5 is a front partial cross cut view of the primary shell and insulator assembly and the ground sleeve after assembly.

After the primary shell and insulator assembly 30, and the electrode donut 20 have been bonded, and machined, the ground sleeve 40 will be pressed on to the primary shell 36 in the direction shown by the arrows in FIG. 4. The larger diameter of barrel portion surface 361 will make it a very tight fit, so for this process the ground sleeve 40 may be heated to temporarily expand diameter of cylindrical surface 401 and make the press easier. The ground sleeve 40 is pressed on until mating surface 403 comes in contact with mating surface 363 of the primary shell 36, shown in FIG. 5. That will put firing surface 203 of the electrode donut 20 directly across from surface area 401 of the ground prongs 42. The area between these two surfaces is the spark potential area G, or the spark gap as it is more commonly called. These areas are where the spark can happen.

Figure 6:
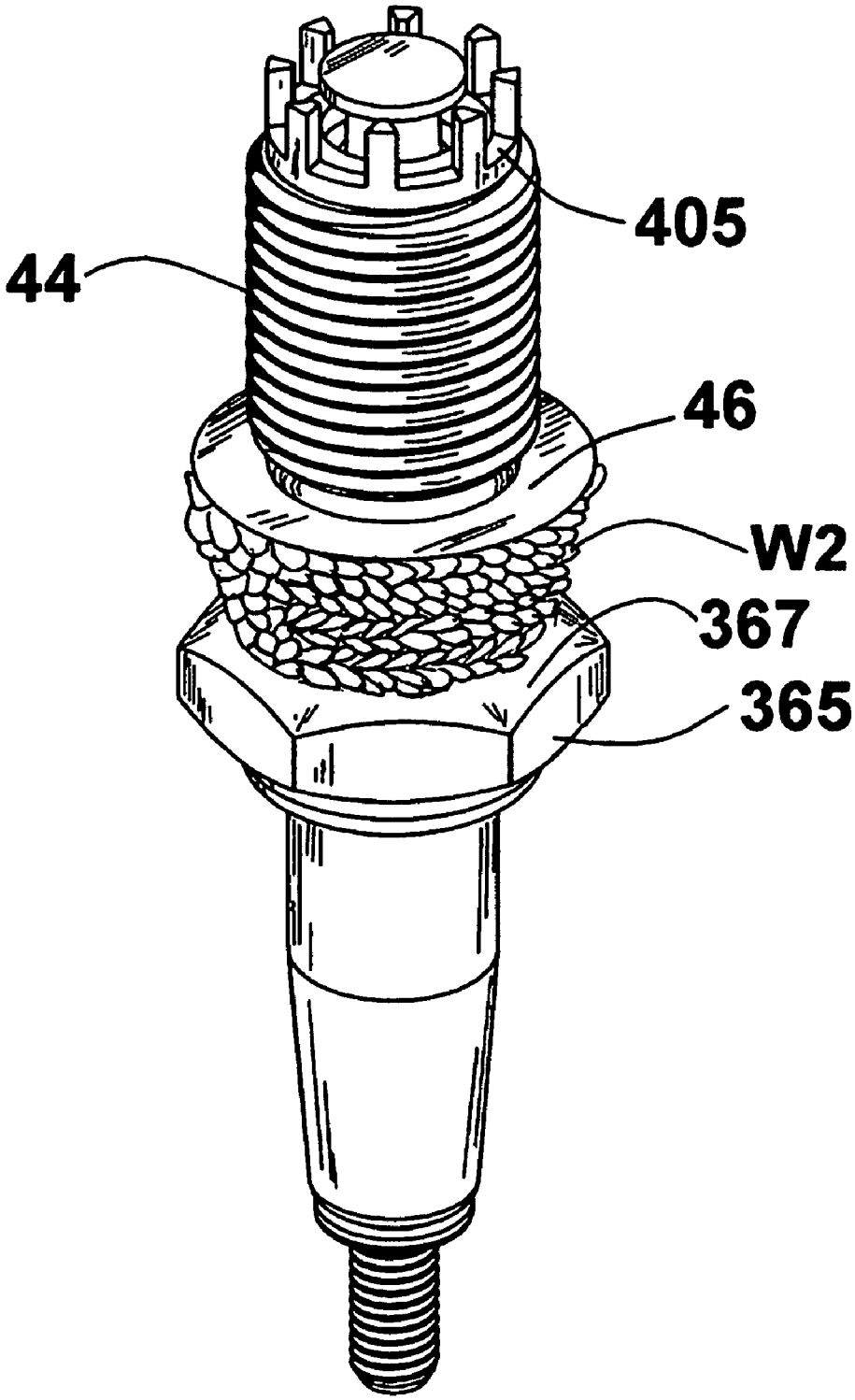
FIG. 6 is a perspective view of the assembled embodiment and the location of the body weld.
Figure 7:
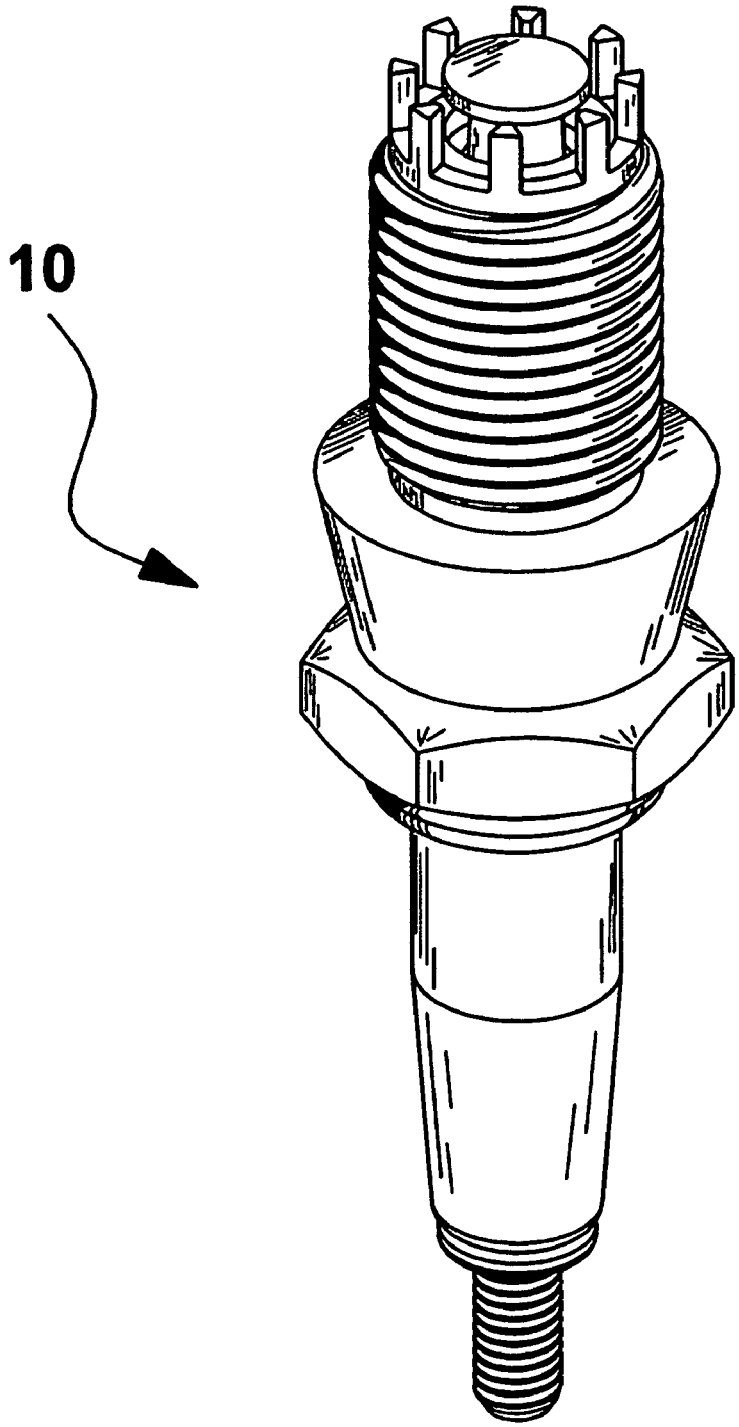
FIG. 7 is a perspective view of the preferred embodiment in its final state.

After ground sleeve 40 is pressed into place it will be permanently attached around the base 46 so as to permanently bond it to the primary shell 36, shown in FIG. 6, as W2. After the ground sleeve 40 is welded to the primary shell 36, the weld W2 will be machined so as to be smooth and polished as shown in FIG. 7 as the preferred embodiment 10 in its final form.

Second Embodiment

Figure 8:
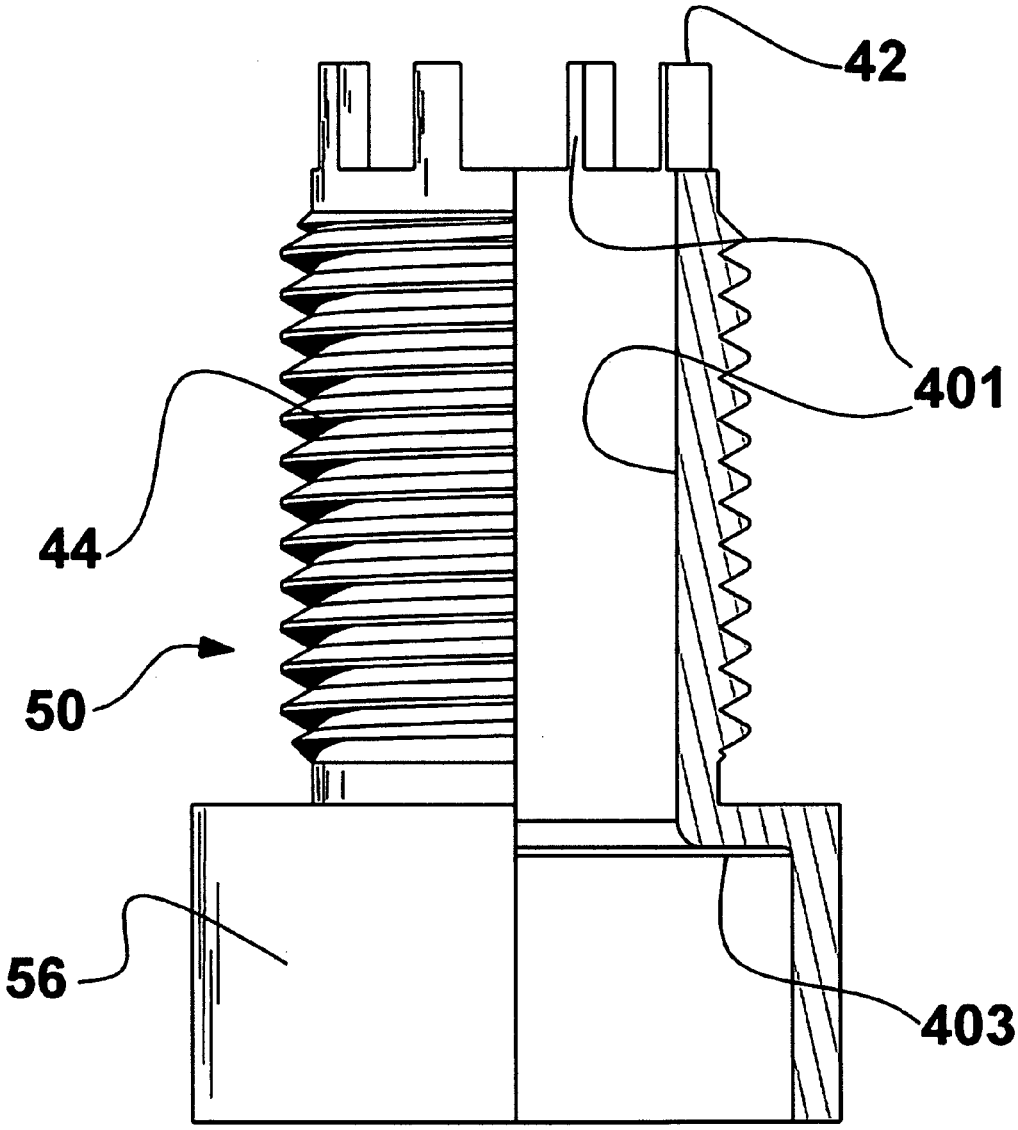
FIG. 8 is a front partial cross cut view of the ground sleeve.
Figure 9:
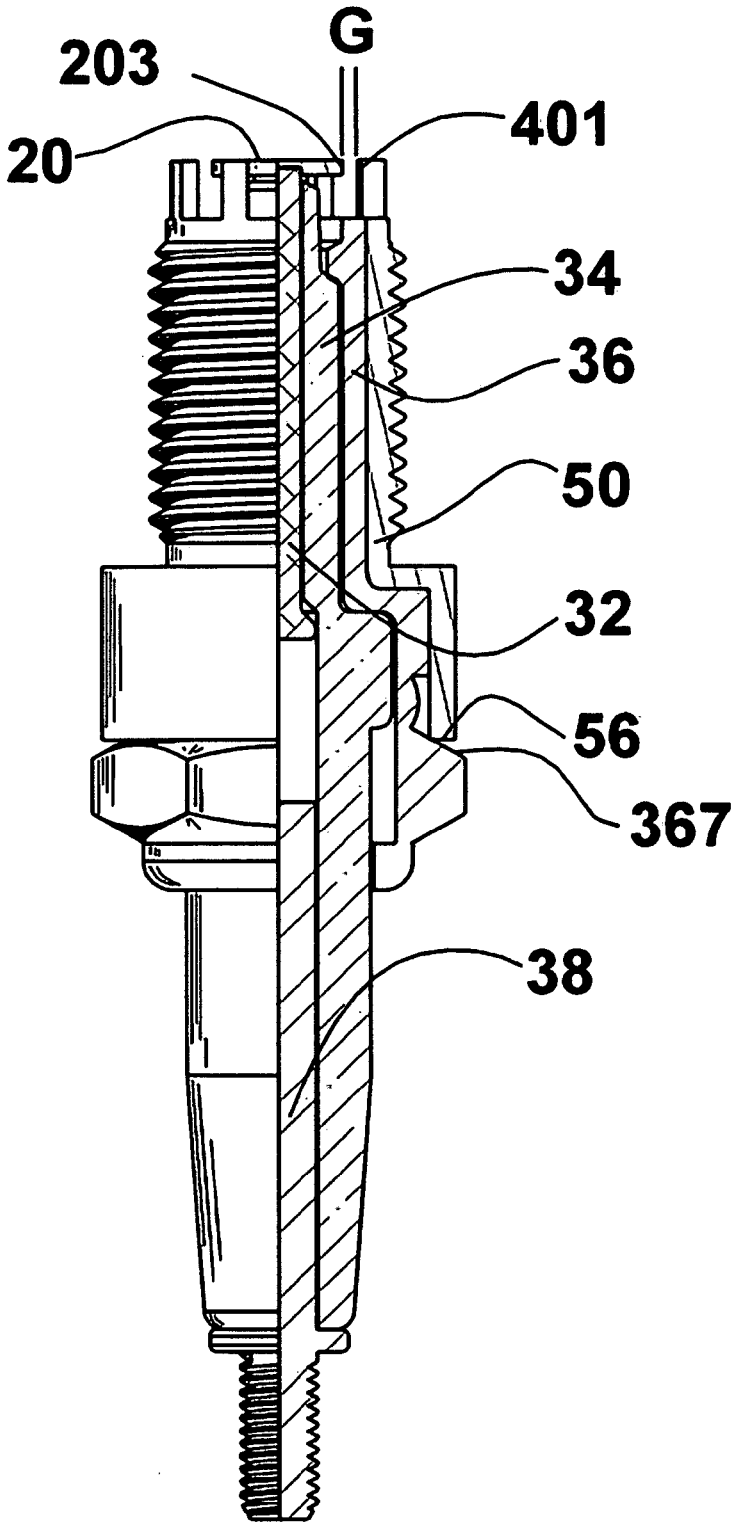
FIG. 9 is a front partial cross cut view of the primary shell and insulator assembly and the ground sleeve after assembly.
Figure 10:
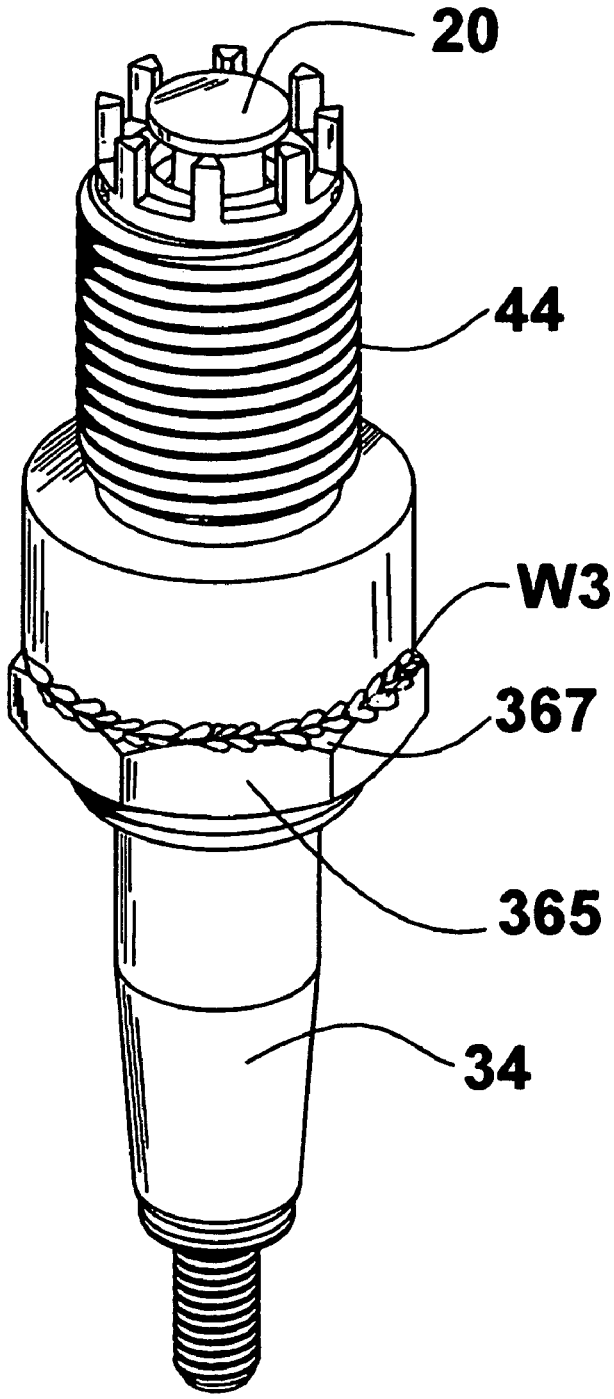
FIG. 10 is a perspective view of the assembled embodiment and the location of the body weld.
Figure 11:
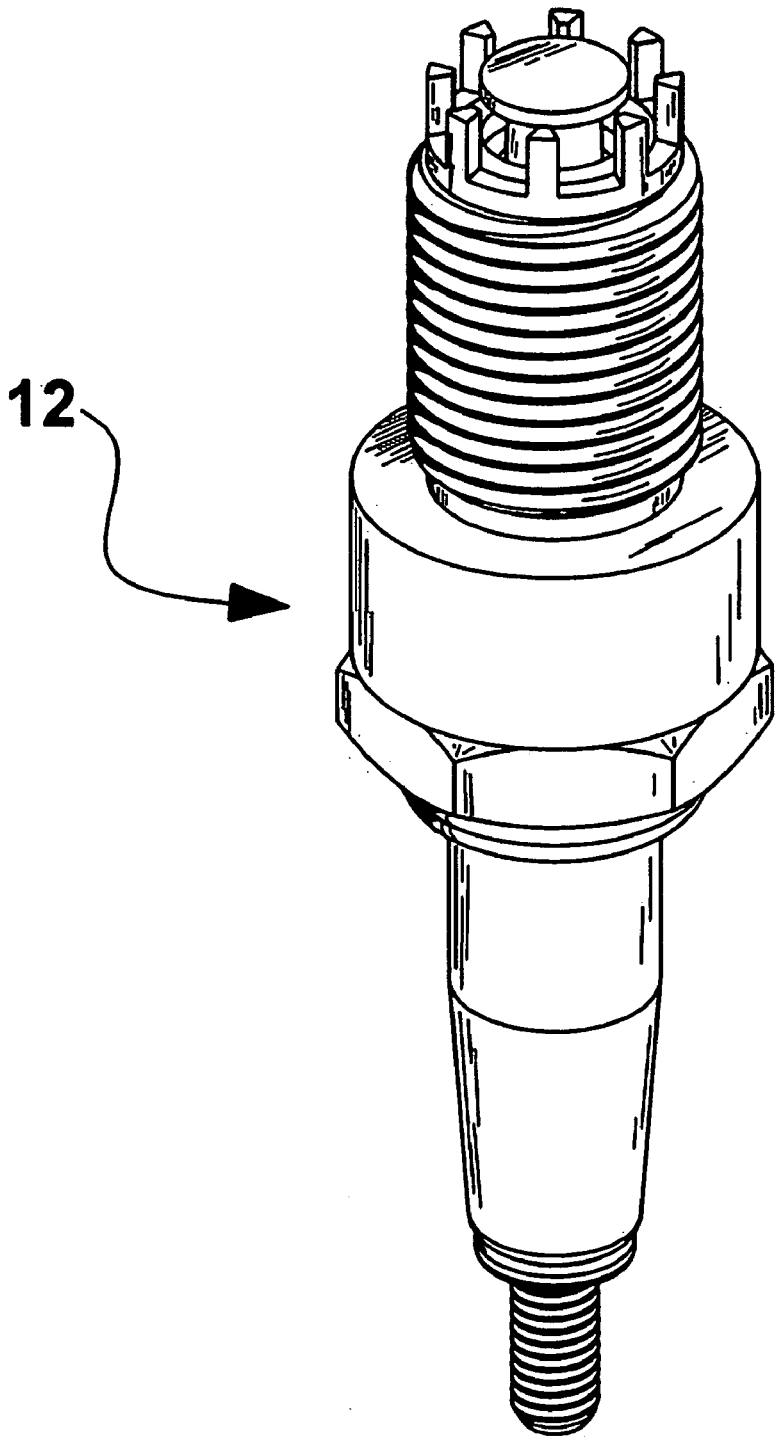
FIG. 11 is a perspective view of the preferred embodiment in its final state.

Ground sleeve 50, in FIG. 8, is pressed on to the primary shell 36 in the same fashion as ground sleeve 40, as shown and described in FIG. 4. The variation of the base 56 extends down so as to come in close proximity with the surface area 367 of the primary shell 36, as shown in FIG. 9. After the ground sleeve 50 is pressed into place it is welded to the primary shell 36 at surface 367 filling the proximal area between base 56 and surface 367 and extending around the circumference, shown in FIG. 10 as W3. After the ground sleeve 50 is welded to the primary shell 36, the weld W3 will be machined so as to be smooth and polished as shown in FIG. 11 as the preferred embodiment 12 in its final form.

Third Embodiment

Figure 12:
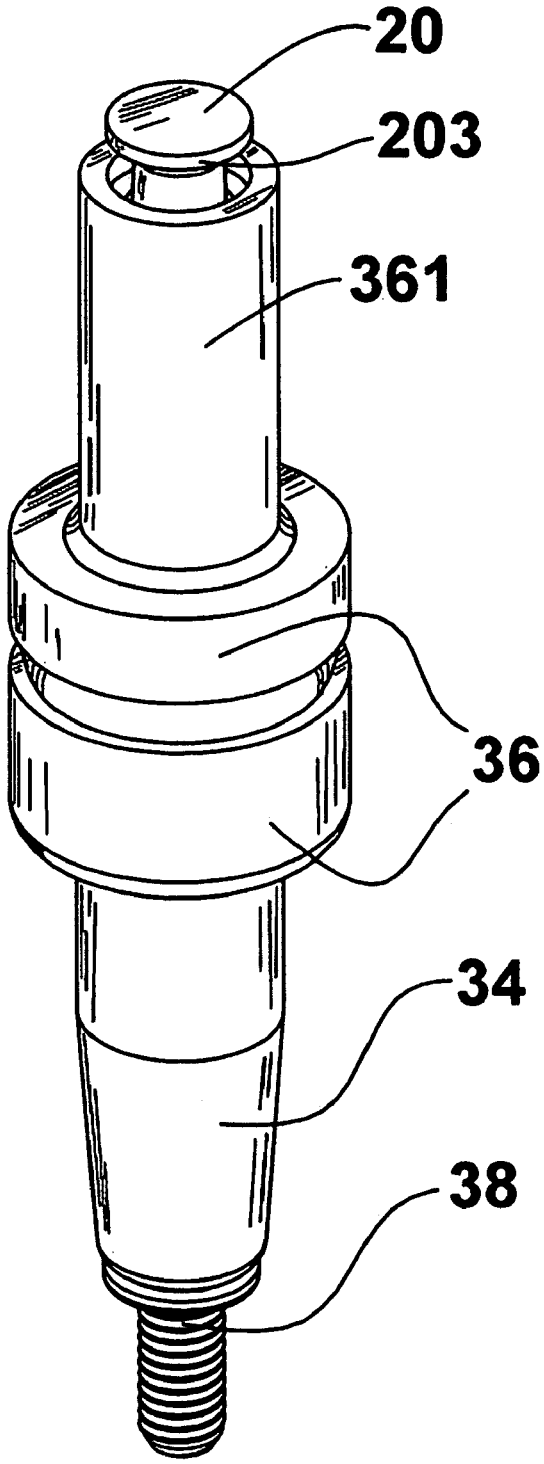
FIG. 12 is a perspective view of the primary shell and insulator assembly and the primary sell variation.
Figure 13:
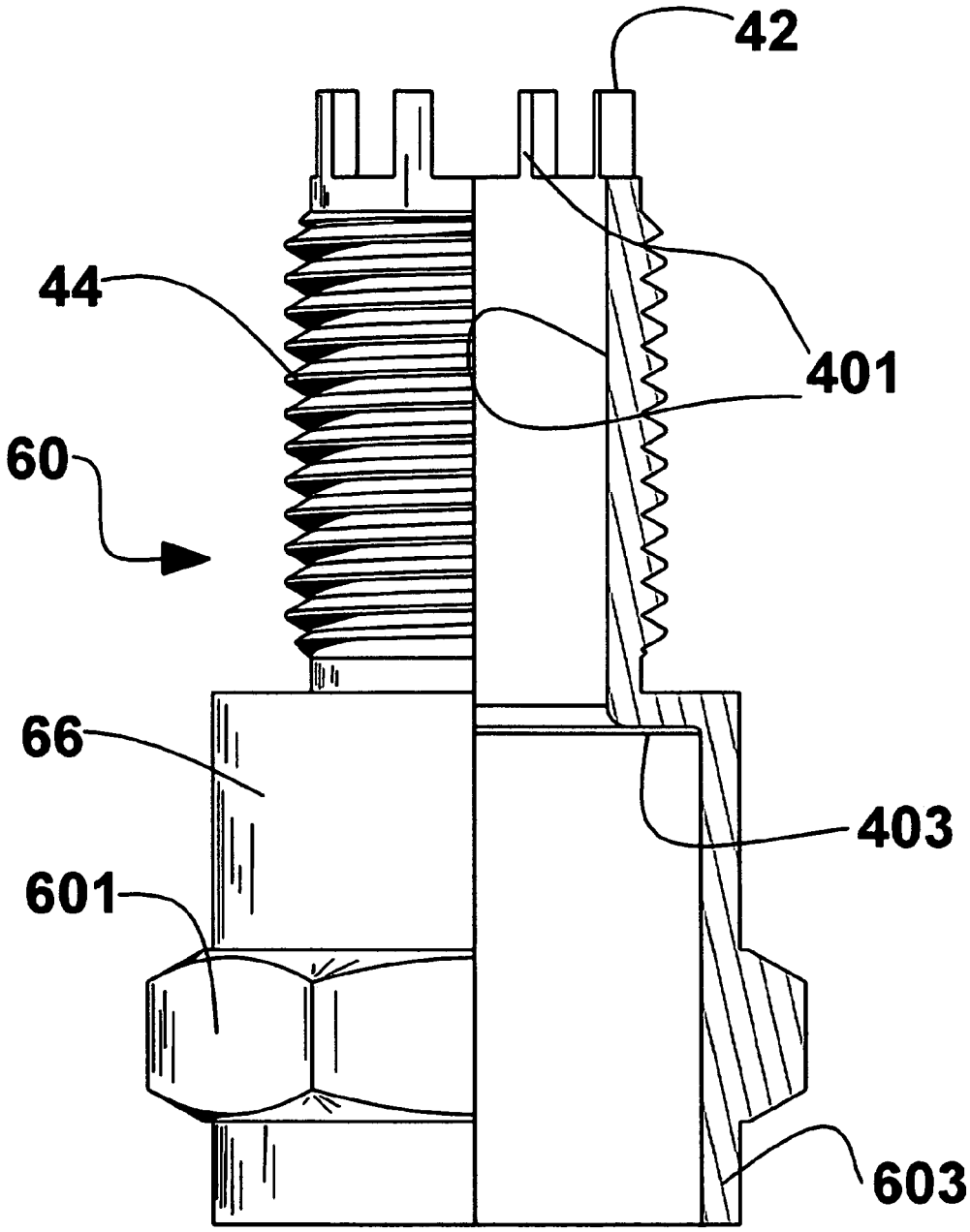
FIG. 13 is a front partial cross cut view of the ground sleeve.
Figure 14:
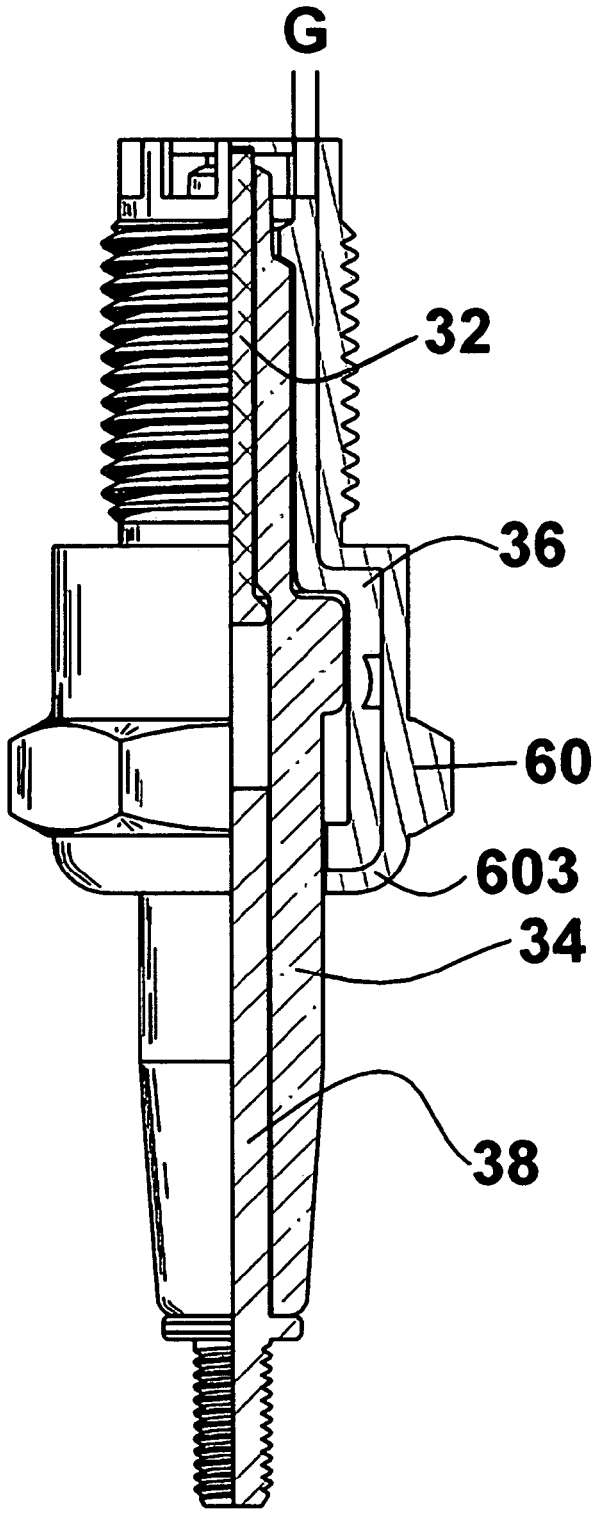
FIG. 14 is a front partial cross cut view of the primary shell and insulator assembly and the ground sleeve after assembly.
Figure 15:
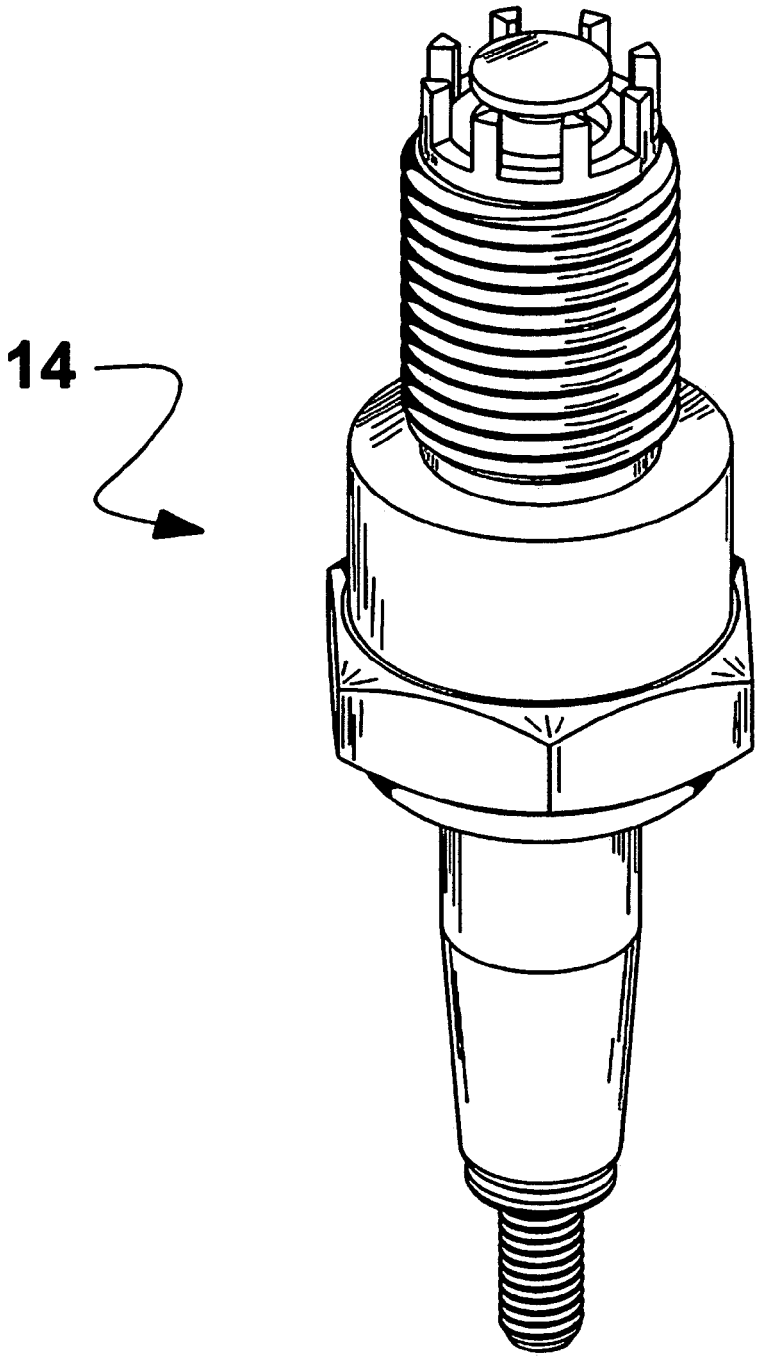
FIG. 15 is a perspective view of the preferred embodiment in its final state.

The mounting nut 365 of the primary shell 36 has been omitted as shown in FIG. 12. The third embodiment uses ground sleeve 60, shown in FIG. 13. Ground sleeve 60, is pressed on to the primary shell 36 in the same fashion as ground sleeve 40, as shown and described in FIG. 4. The variation of the base 66 extends down to include the mounting nut 601 and flange 603. After ground sleeve 60 is pressed into place flange 603 will be bent in, up and around the bottom portion of primary shell 36 as shown in FIG. 14. This method requires no welding. FIG. 15 shows preferred embodiment 14 in its final form.

Figure 16:
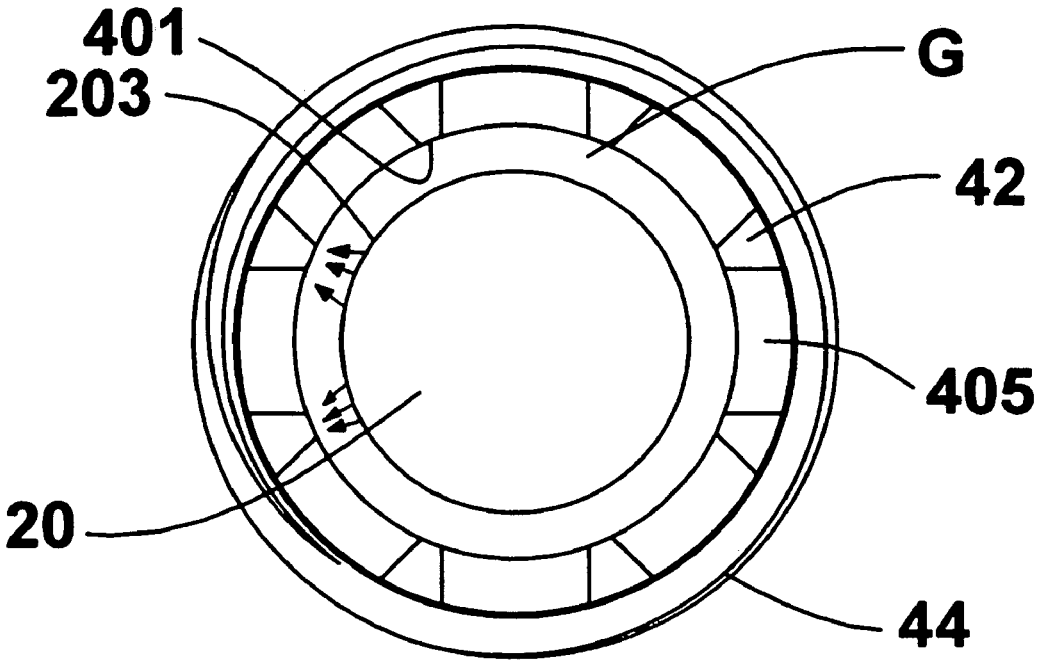
FIG. 16 is a top view of the firing end configuration.
Figure 32:
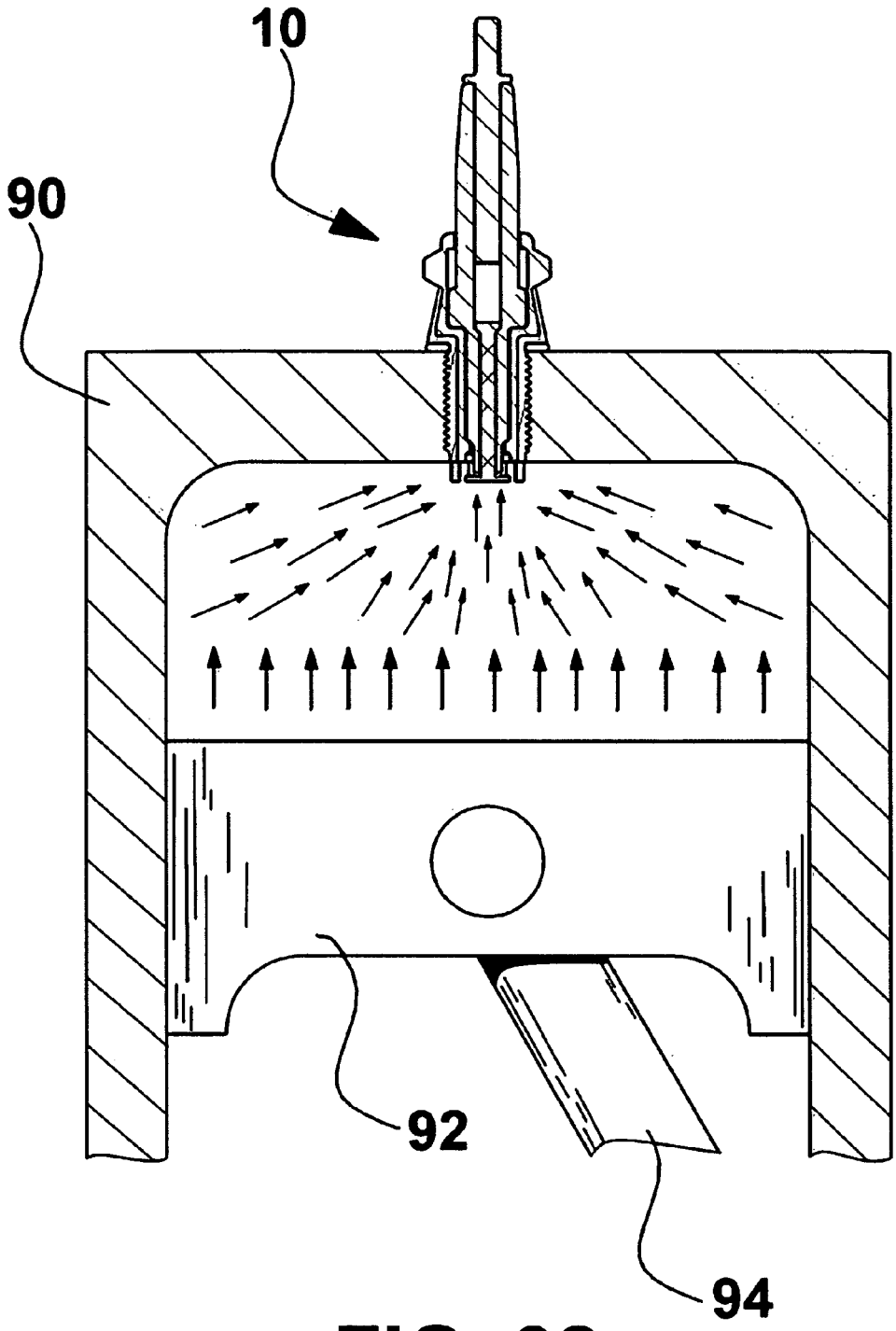
FIG. 32 is a frontal view of the cylinder showing the piston in relation to the sparkplug and the compressing of the air fuel mixture.
Figure 33:
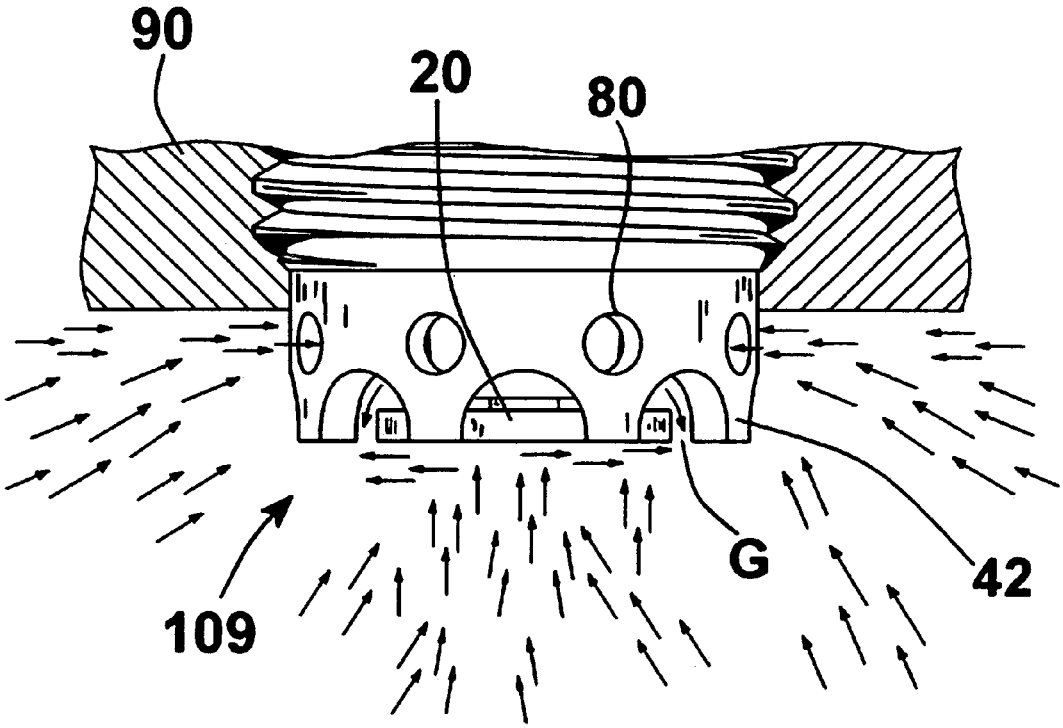
FIG. 33 is a frontal cut away view of the cylinder showing the intended flow of the air fuel mixture in and around the firing surfaces of the electrode and grounding prongs.

FIG. 16 shows a top view of the firing end, the little arrows show how the electromotive force from the ignition coil radiates out from firing surface 203 of the positive electrode 20 to establish an ionization path to ground, that is surface area 401 of the prongs 42, so that the electrons can flow though the ionization path, and the compressed air fuel mixture like they would do though a solid wire. When the electrons flow, they are very hot so as to ignite the air fuel mixture. This happens in less than 0.001 of a second, the faster the better. The combustion chamber environment is very turbulent do to the compressing of the air fuel mixture, as shown by the little arrows in FIG. 32, this happens inside the cylinder 90. During the compression, the air fuel mixture is being smashed, and squeezed, by the piston 92 that connects to the piston rod 94, in the direction of the sparkplugs firing end blowing the ionization path out several times before it can be established. So having multiple points, and more spark potential area G, is very beneficial, this is why the spark potential area G must be exactly the same physical distance as one another so as not to have any physical bias. This will give the ionization a path of least resistance based on the flow of the air fuel mixture at the precise time of the firing as seen in FIG. 33.

FIG. 17-FIG. 31 shows prime examples of what we are trying to achieve with the flow of the air fuel mixture, to help establish the ionization path, by pushing it in the direction of the ground prongs 42, but do to the fact that the environment is so turbulent it may only do this in one, two or three areas, but it only needs one at a time. This will greatly improve the performance of the sparkplug which in turn will improve the performance of the internal combustion engine.

To determine the exact characteristics of the firing end we use formulas based on the diameter of the ground sleeve cylindrical surface 401 of FIG. 3 that is the distance across the top between the prongs 42 and is the base dimension to determine the characteristics of the spacing of the prongs 42, with cut outs 70, 72, 74, and the port holes 80, 82.

For example purposes we use the standard size 14 mm, but can achieve the same characteristics for 18 mm, 12 mm and 10 mm applications these are also common sizes for sparkplugs but would have different base dimensions.

Figure 17:
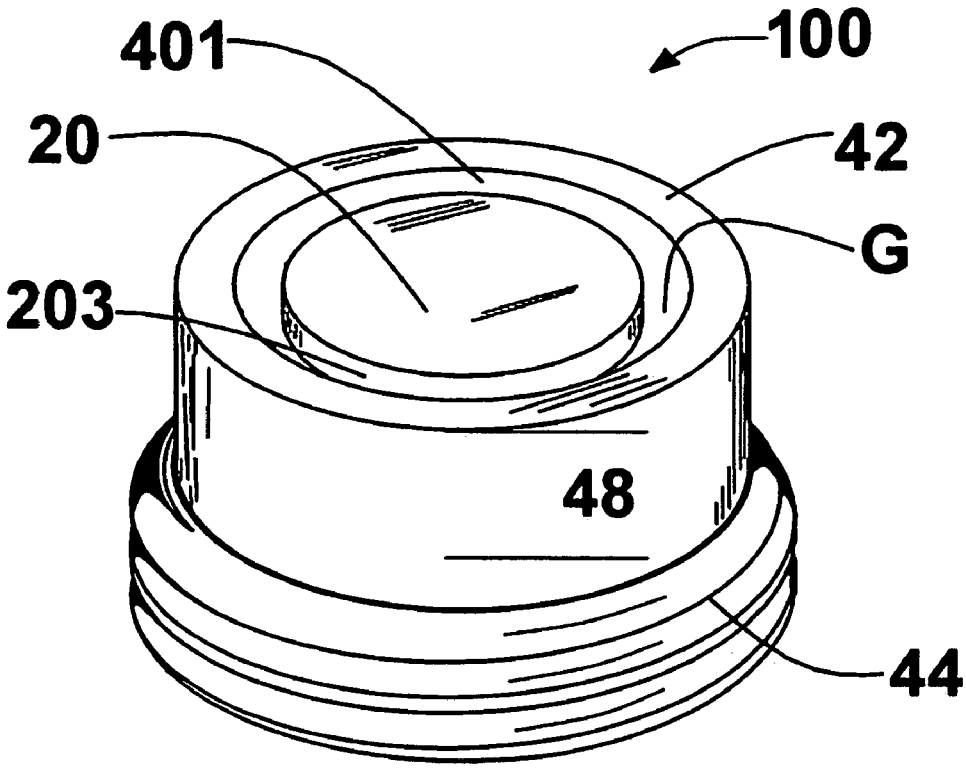
FIG. 17 is a partial perspective view of the firing end configuration example of the preferred embodiments.

FIG. 17 shows example 100. This has no port holes and no cut outs. To determine the depth 48 that the firing end will protrude into the combustion chamber we use the base dimension for a 14 mm sparkplug which is 0.375". The formula is 0.375/3=0.125". If we need to go deeper we use a smaller divisor. The depth 48 is added to the reach of the sparkplug, which is the distance from the base 46 to surface 405 of the ground sleeve 40 as shown in FIG. 6. Surface 405 is the threshold into the firing cylinder.

Figure 18:
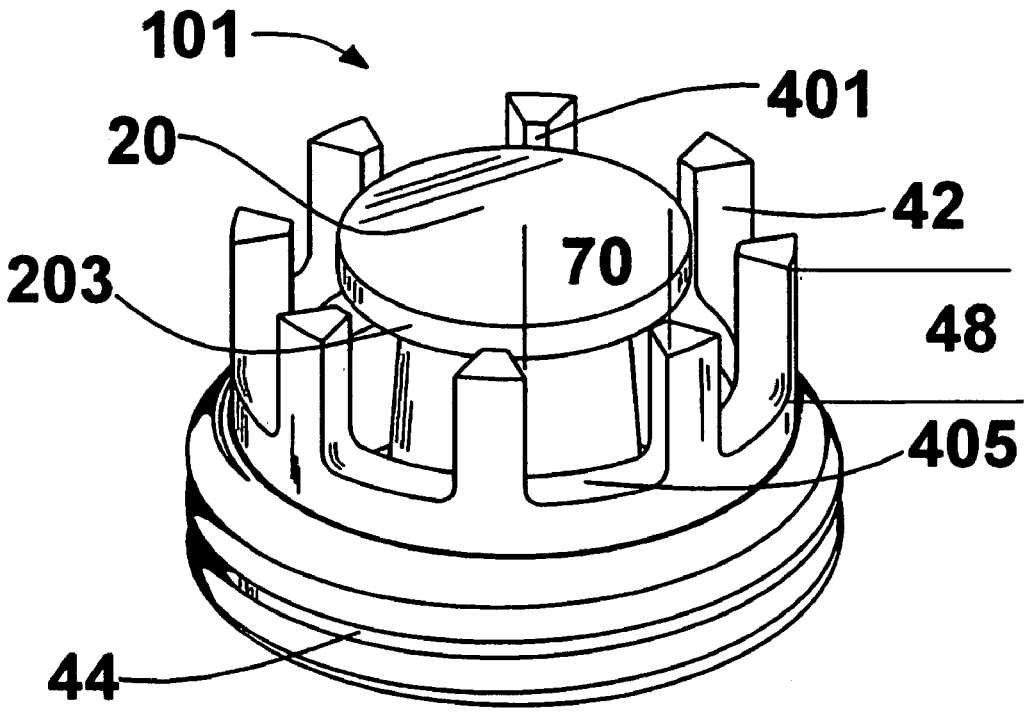
FIG. 18 is a partial perspective view of the firing end configuration example 101, of the preferred embodiments.

FIG. 18 shows example 101. This has 8 cut outs 70 and no port holes. The depth of the cut outs 70 in example 101, go to the surface of 405 so that would make it 0.375/3=0.125" deep, if we need to go shallower we use a smaller divisor. The formula for the width of the cut outs 70 are based on the 0.375" diameter as well. This is 0.375/3=0.125". The cut outs 70 are spaced evenly around the ground sleeve 40 in 8 places as shown in FIG. 18.

Figure 19:
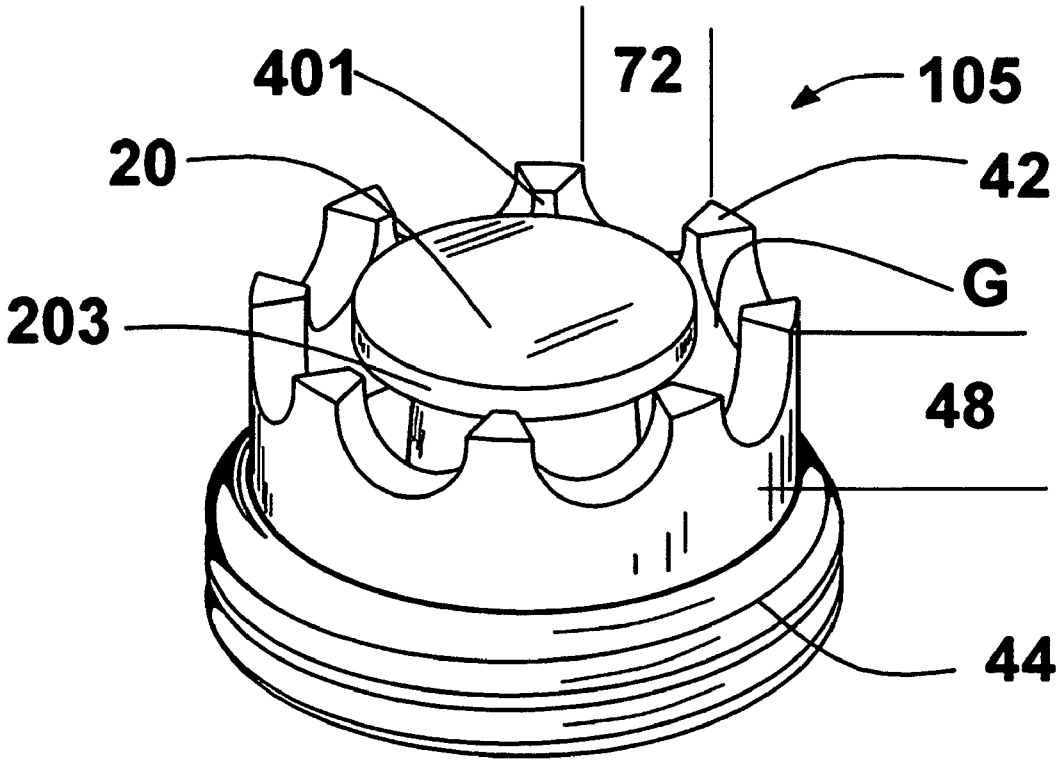
FIG. 19 is a partial perspective view of the firing end configuration example 105, of the preferred embodiments.

FIG. 19 shows example 105. This has 8 cut outs 72 and no port holes. The cut outs 72 are different so as to be completely round. The formula for this is, the base dimension which is 0.375" is 0.375/3×0.5=0.0625" radius. So the widths of the cut outs 72 are 0.125" and is basically a half hole, with the center at the end of the prongs 42 so that the bottom of the radios is half of the depth 48. These are spaced evenly around the ground sleeve 40 in 8 places as well.

Figure 20:
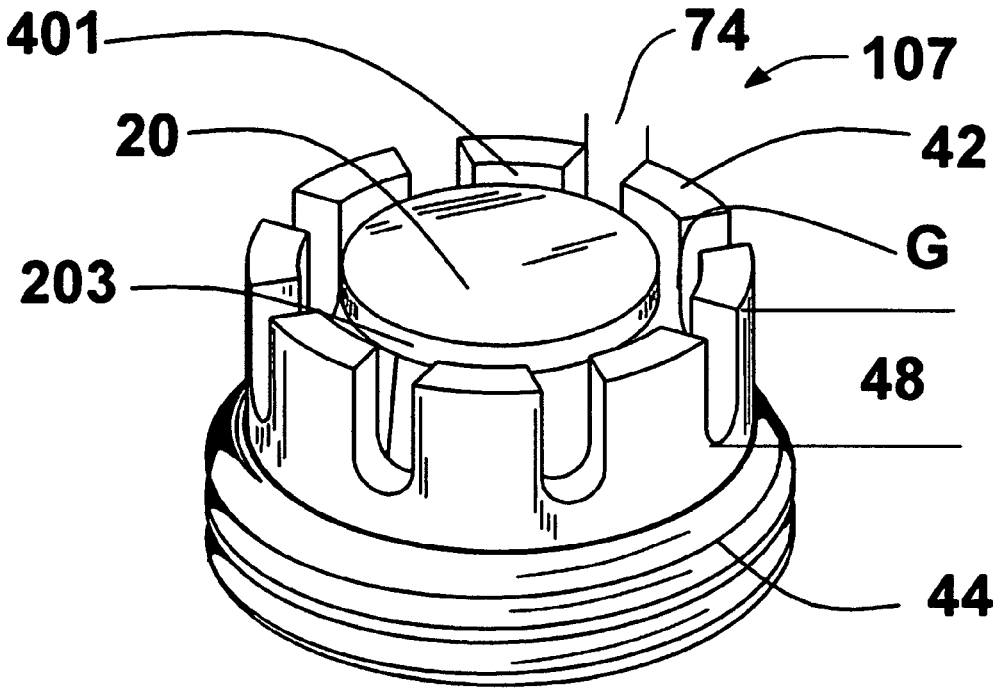
FIG. 20 is a partial perspective view of the firing end configuration example 107, of the preferred embodiments.

FIG. 20 shows example 107, this has 8 cut outs 74 and no port holes. The cut outs 74 are different so as to be thinner and round at the bottom. The formula for this is, the base dimension which is 0.375" is 0.375/6=0.0625". So the widths of the cut outs 74 are 0.0625". These are spaced evenly around the ground sleeve 40 in 8 places as well.

Figure 21:
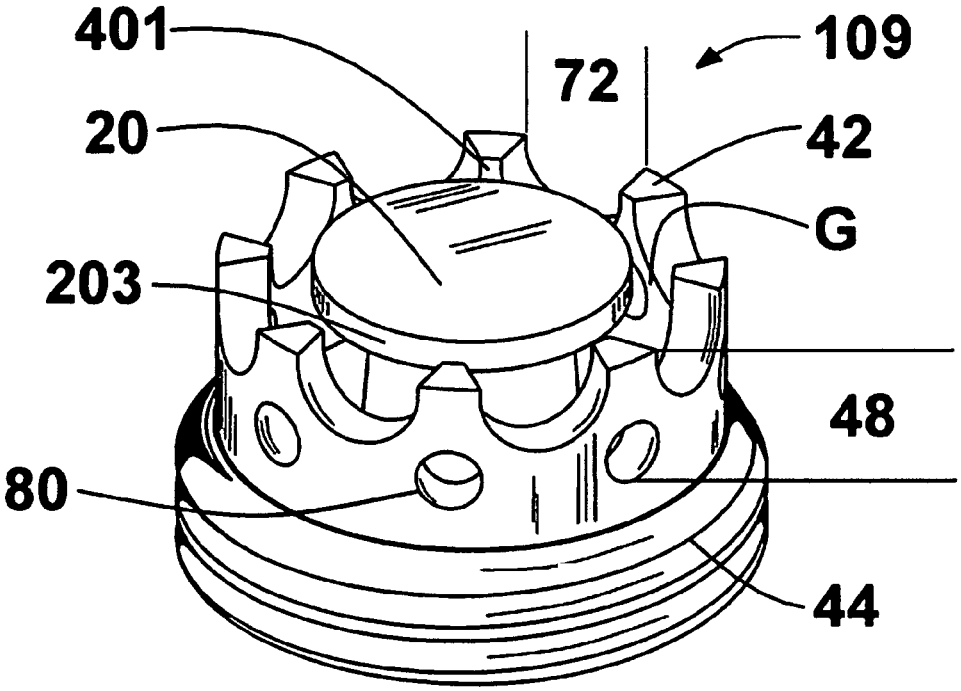
FIG. 21 is a partial perspective view of the firing end configuration example 109, of the preferred embodiments.

FIG. 21 shows example 109. This has 8 cut outs 72 and 8 port holes 80. The port holes are located directly under the prongs 42 and are located so that the bottom of the port hole 80 is at the threshold of the depth 48. The size of the port holes 80 are determined by the base dimension of 0.375" as well. Which is 0.375/6=0.0625, the diameter of port hole 80. These are spaced evenly around the ground sleeve 40 in 8 places as described as well.

Figure 22:
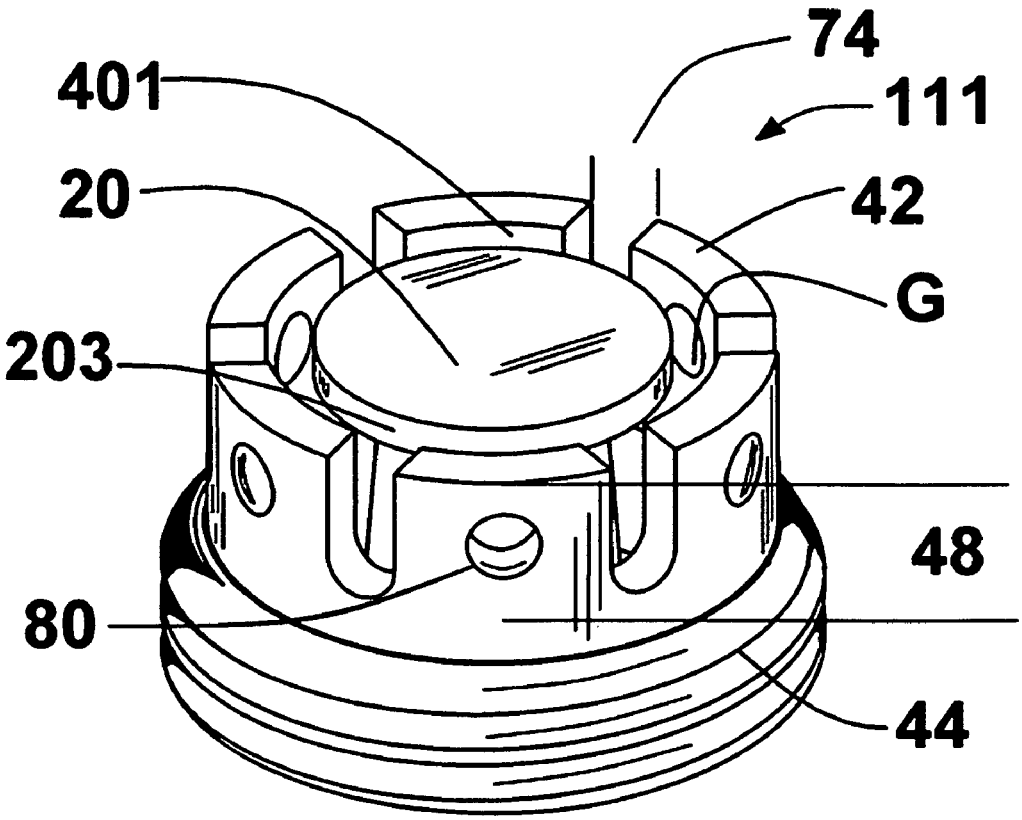
FIG. 22 is a partial perspective view of the firing end configuration example 111, of the preferred embodiments.

FIG. 22 shows example 111. This has 6 cut outs 74 and 6 port holes 80. As shown.

Figure 23:
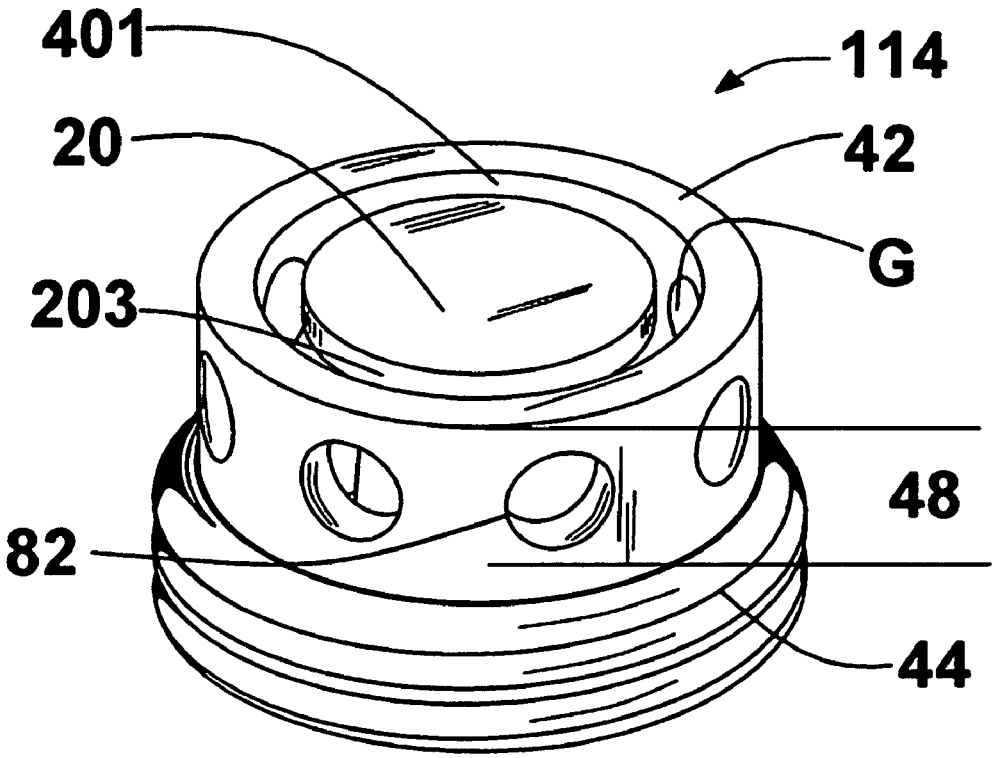
FIG. 23 is a partial perspective view of the firing end configuration example 114, of the preferred embodiments.

FIG. 23 shows example 114. This has no cut outs and 8 port holes 82. The size of the port holes 82 are determined by the base dimension of 0.375" as well. Which is 0.375/4=0.0938, the diameter of port hole 82. These are spaced evenly around the ground sleeve 40 in 4 places as described as well.

Figure 24:
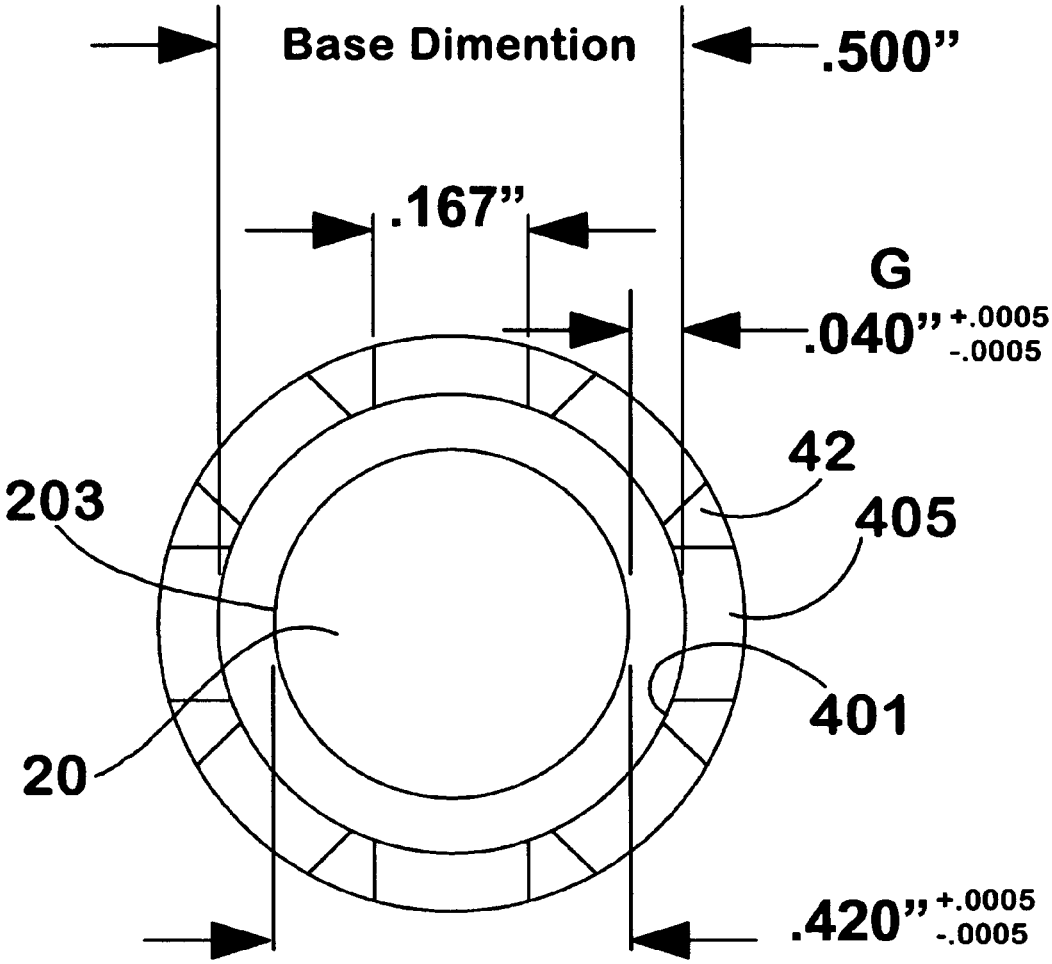
FIG. 24 is a top view of the firing end configuration showing an example of 18 mm dimensions.
Figure 25:
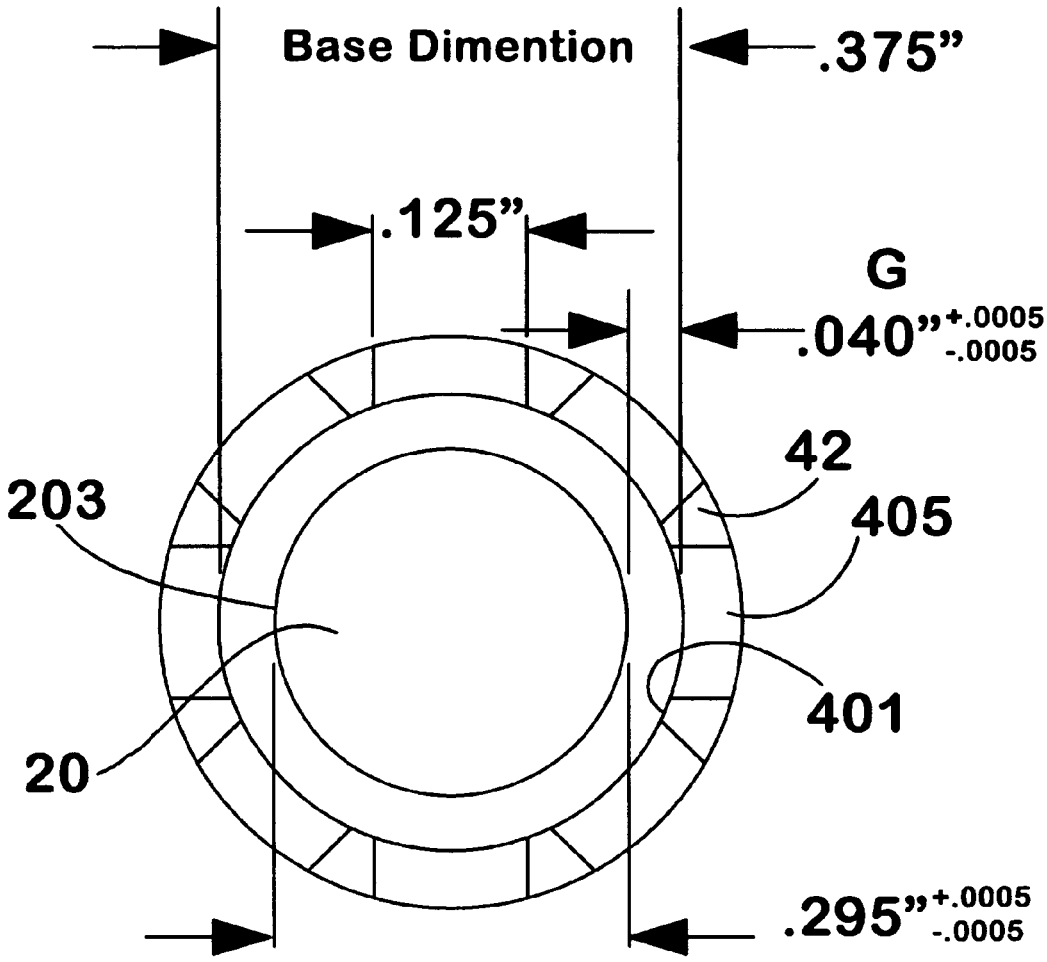
FIG. 25 is a top view of the firing end configuration showing an example of 14 mm dimensions.
Figure 26:
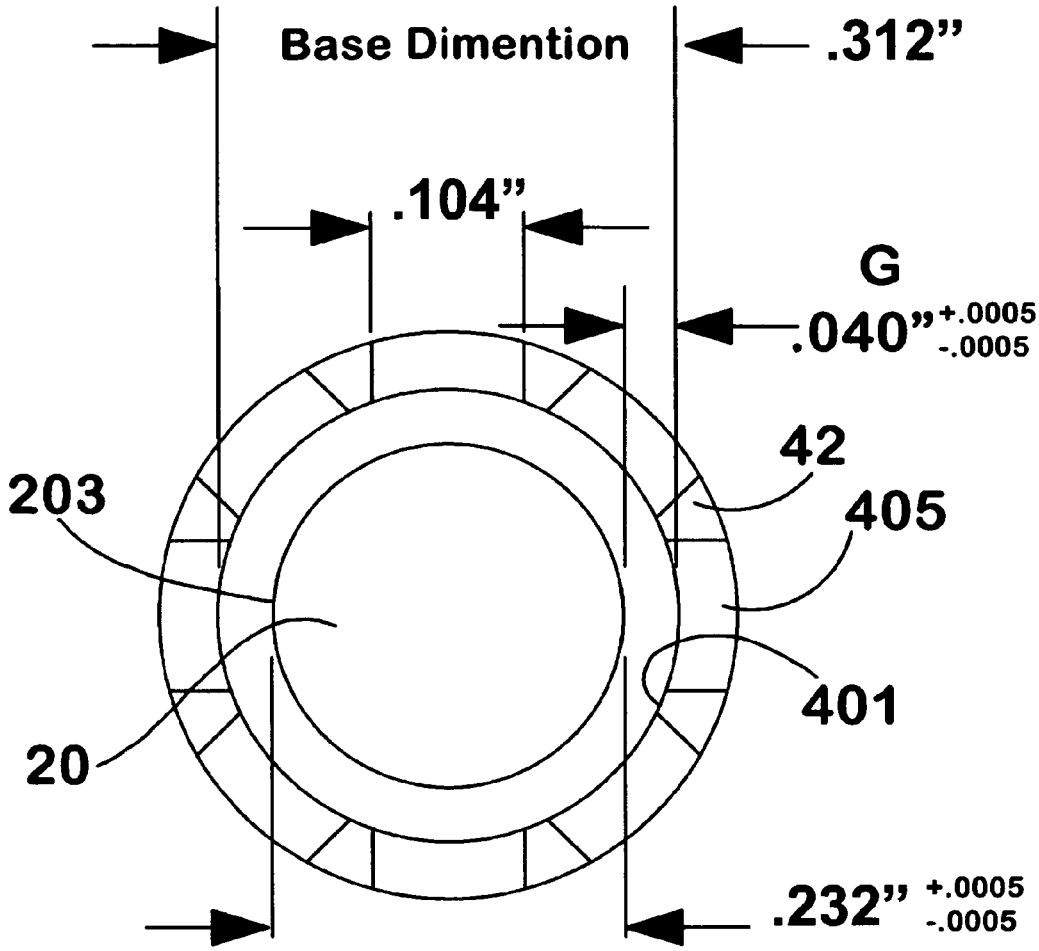
FIG. 26 is a top view of the firing end configuration showing an example of 12 mm dimensions.
Figure 27:
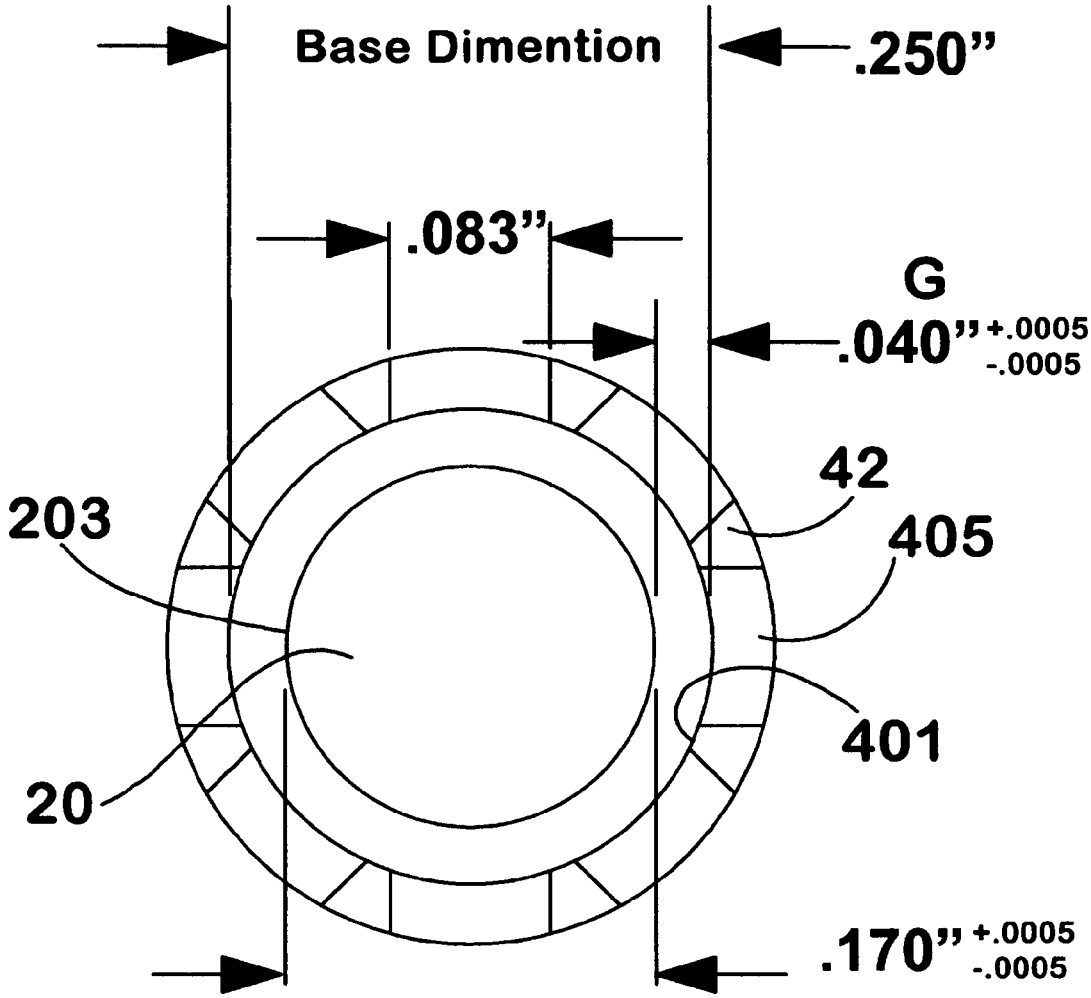
FIG. 27 is a top view of the firing end configuration showing an example of 10 mm dimensions.
Figure 28:
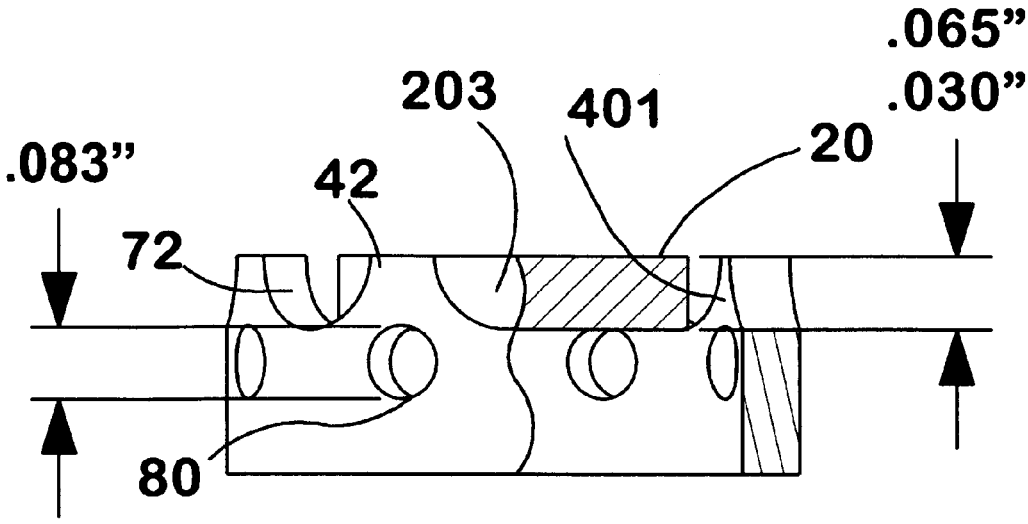
FIG. 28 is a front view of the firing end configuration showing an example of 18 mm dimensions.
Figure 29:
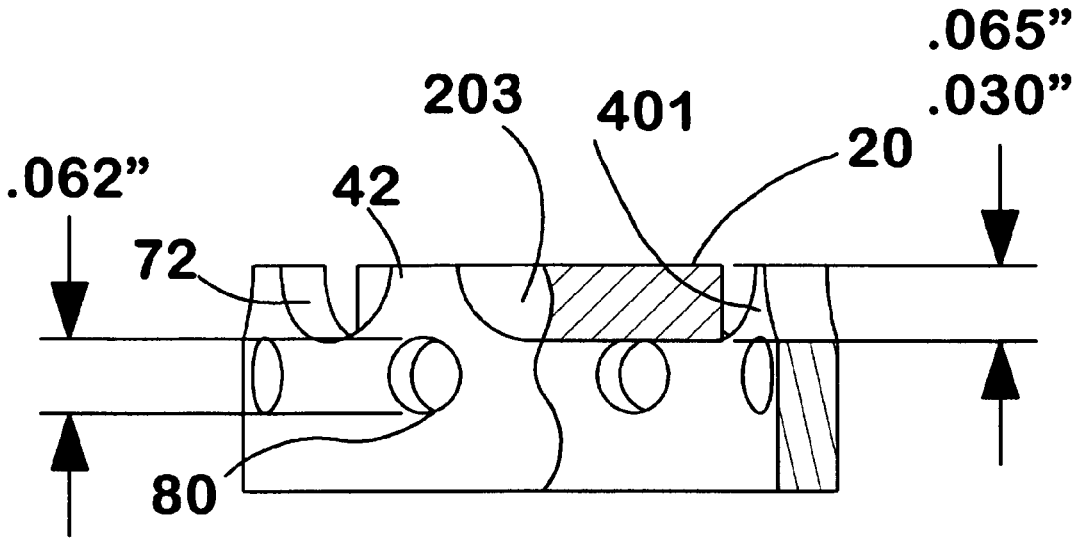
FIG. 29 is a front view of the firing end configuration showing an example of 14 mm dimensions.
Figure 30:
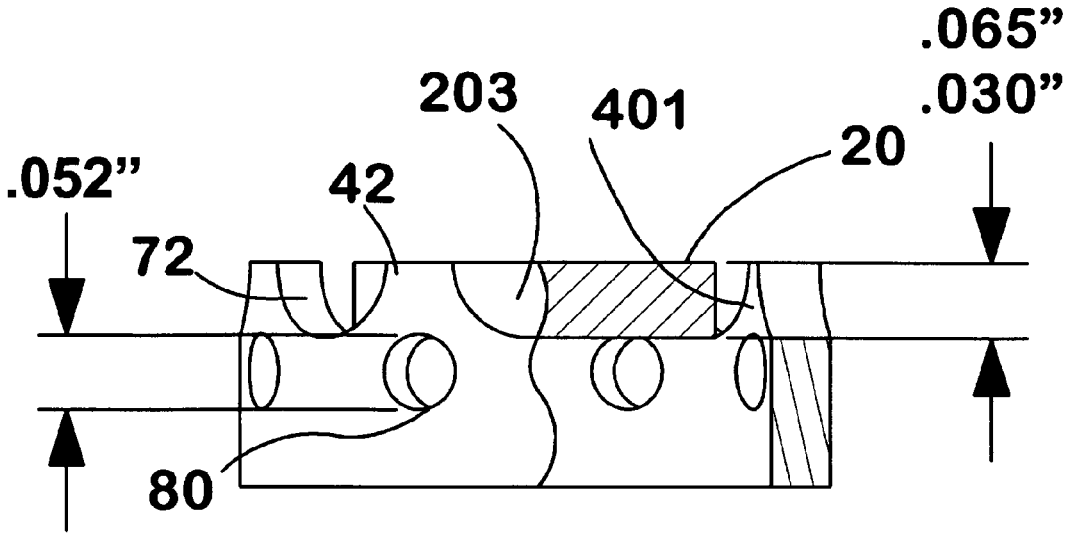
FIG. 30 is a front view of the firing end configuration showing an example of 12 mm dimensions.
Figure 31:
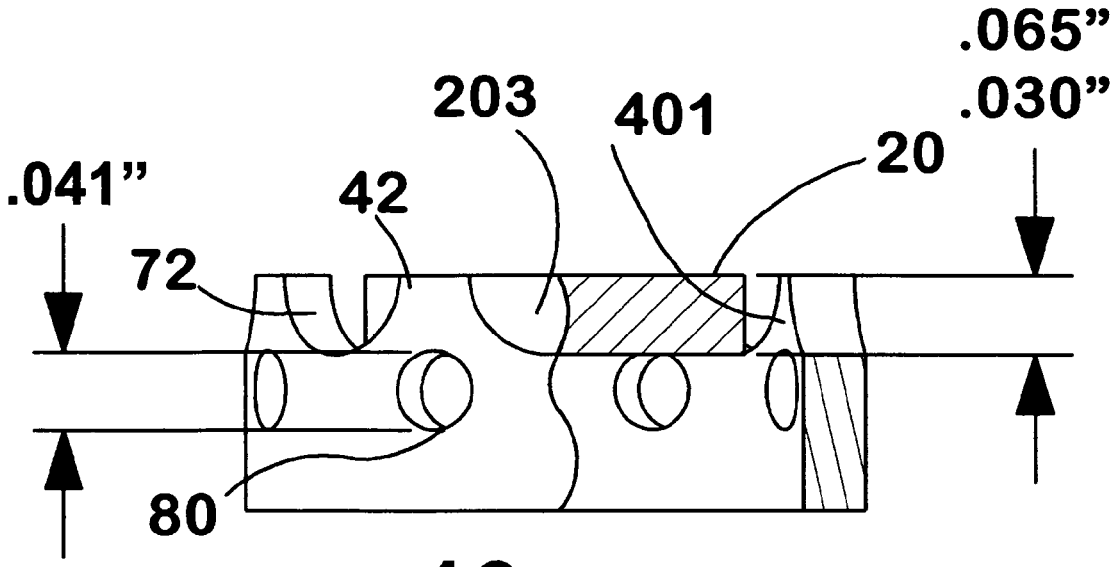
FIG. 31 is a front view of the firing end configuration showing an example of 10 mm dimensions.

FIGS. 24-31 are examples of dimensions for the standard sized sparkplugs showing the base dimension for that specific sized application and specific gap size. FIGS. 24, 25, 26 and 27 show dimensions for the width of the cut out, the diameter of the electrode donut and its tolerance, and the tolerance of the spark potential area which is commonly called the gap. FIGS. 28, 29, 30, and 31 show the thickness of the electrode donut and the diameter of the port holes. FIGS. 24 and 28 shows examples of 18 mm dimensions with a 0.040" spark potential area. FIGS. 25 and 29 shows examples of 14 mm dimensions with a 0.040" spark potential area. FIGS. 26 and 30 shows examples of 12 mm dimensions with a 0.040" spark potential area. FIGS. 27 and 31 shows examples of 10 mm dimensions with a 0.040" spark potential area.

The multiple sparkplugs are different only in the fact that they are designed to perform with in the realms of a specific application but can still be used in an enormous number of applications and other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although they are different in appearance, and have variations of there design they are all, manufactured and assembled, to perform in the true spirit and scope of the invention.

Having thus described the invention, what is desired to be protected by Letters Patent is presented in the subsequently appended claims.

What is claimed is:

1. A sparkplug for the internal combustion engine comprising:

a) a core electrode having a horizontal firing end a horizontal terminal end and a center line, wherein i) the horizontal firing end is connected to the horizontal terminal end vertically by an outside diameter, ii) the outside diameter is parallel with the center line and is a predetermined size, b) an insulator that wraps around the core electrode horizontal terminal end tightly surrounding a portion of the core electrode outside diameter and protruding vertically in the direction towards the horizontal firing end of the core electrode and terminating prior to the horizontal end, whereby leaving a portion of the electrode cores diameter not surrounded by the insulator, c) an electrode donut that is flat with a thickness that is no less than 0.030" and no more than 0.065" having an outside diameter firing surface, an inside diameter locating hole and a flat top, wherein i) the inside diameter locating hole is no less than 0.002" larger and no more than 0.005" larger than the outside diameter of the core electrode and wraps around the core electrode outside diameter surrounding the portion that is not surrounded by the insulator, whereby being located between the horizontal firing end of the core electrode and the insulator and is permanently bonded to the core electrode by means of welding, d) a primary shell that wraps around the insulator surrounding the horizontal terminal end of the electrode core having a barrel portion that protrudes vertically in the direction towards the horizontal firing end of the core electrode and terminates prior to the electrode donut leaving a portion of the insulator not surrounded by the primary shell, wherein i) the barrel portion has a diameter that is a locating surface and is exactly concentric to the firing surface of the electrode donut whereby being the means for exact horizontal central location, ii) the portion of the primary shell that does not protrude creates a horizontal surface that is a mating surface and is perpendicular to the center line of the core electrode whereby being the means for vertical location, e) a ground sleeve with a horizontal firing end, a horizontal shoulder end and a cylindrical surface, wherein i) the cylindrical surface has an inside diameter that is a base dimension with a variable numeric value used in multiple formulas whereby being the means to determine the size of;

a. the diameter of the electrode donut, b. the diameter of the barrel portion of the primary shell, ii) a portion of the cylindrical surface presses vertically on to the barrel portion locating surface of the primary shell terminating at the shoulder portion mating surface of the primary shell whereby the horizontal firing end is disposed contiguous with the flat top of the electrode donut, iii) a portion of the cylindrical surface surrounds the firing surface of the electrode donut at the horizontal firing end of the core electrode and terminates vertically prior to the firing surface of the electrode donut creating a horizontal gap that extends vertically in the direction towards the horizontal shoulder end whereby being a spark potential area, iv) the spark potential area is no more than 0.0005" larger and no more than 0.0005" smaller than the predetermined size, whereby having no physical bias, v) the ground sleeve is partially wrapped with mounting threads, and has an attachment surrounding the shoulder portion of the primary shell and is made permanent by means of welding or flange.

2. The sparkplug of claim 1, wherein the portion of the ground sleeve that surrounds the electrode donut further comprises a cut out, wherein a) the horizontal width of the cut out is $\frac{1}{3}^{rd}$ the diameter of the base dimension, b) the vertical depth of the cut out is $\frac{1}{3}^{rd}$ the diameter of the base dimension, c) the cut out further being the means to direct the air fuel mixture away from the electrode donut.

3. The sparkplug of claim 2, wherein there are no less than 2 cut outs spaced evenly.

4. The sparkplug of claim 3, wherein the portion of the ground sleeve that surrounds the electrode donut further comprises a plurality of port holes, wherein a) the port holes are $\frac{1}{6}^{th}$ the diameter of the base dimension, b) the port holes are located respectively alternating to the cut outs, c) the port holes further being the means to direct the air fuel mixture towards the electrode donut.

5. The sparkplug of claim 2, wherein a) the horizontal width of the cut out is $\frac{1}{6}^{th}$ the diameter of the base dimension, b) the vertical depth of the cut out is $\frac{1}{3}^{rd}$ the diameter of the base dimension.

6. The sparkplug of claim 5, wherein there are no less than 2 cut outs spaced evenly.

7. The sparkplug of claim 6, wherein the portion of the ground sleeve that surrounds the electrode donut further comprises a plurality of port holes, wherein a) the port holes are $\frac{1}{6}^{th}$ the diameter of the base dimension, b) the port holes are located respectively alternating to the cut outs, c) the port holes further being the means to direct the air fuel mixture towards the electrode donut.

8. The sparkplug of claim 1, wherein a) the horizontal width of the cut out is $\frac{1}{3}^{rd}$ the diameter of the base dimension, b) the vertical depth of the cut out is a radius that is $\frac{1}{3}^{rd}$ the diameter of the base dimension divided by 2.

9. The sparkplug of claim 8 wherein there are no less than 2 cut outs spaced evenly.

10. The sparkplug of claim 9, wherein the portion of the ground sleeve that surrounds the electrode donut further comprises a plurality of port holes, wherein a) the port holes are $\frac{1}{6}^{th}$ the diameter of the base dimension, b) the port holes are located respectively alternating to the cut outs, c) the port holes further being the means to direct the air fuel mixture towards the electrode donut.

11. The sparkplug of claim 1, wherein the portion of the ground sleeve that surrounds the electrode donut further comprises a port hole, wherein a) the diameter of the port hole is $\frac{1}{6}^{th}$ the diameter of the base dimension, b) the port hole further being the means to direct the air fuel mixture towards the electrode donut.

12. The sparkplug of claim 11, wherein there are no less than 2 port holes spaced evenly.

13. The sparkplug of claim 12, wherein the diameter of the port hole is $\frac{1}{4}^{th}$ the diameter of the base dimension.

14. The sparkplug of claim 1, wherein the ground sleeve is partially wrapped with 18 mm standard size sparkplug threads.

15. The sparkplug of claim 1, wherein the ground sleeve is partially wrapped with 14 mm standard size sparkplug threads.

16. The sparkplug of claim 1, wherein the ground sleeve is partially wrapped with 12 mm standard size sparkplug threads.

17. The sparkplug of claim 1, wherein the ground sleeve is partially wrapped with 10 mm standard size sparkplug threads.

* * * * *